US006308696B1

(12) United States Patent
Kondo et al.

(10) Patent No.: US 6,308,696 B1
(45) **Date of Patent: *Oct. 30, 2001**

(54) IGNITION APPARATUS FOR USE IN INTERNAL COMBUSTION ENGINE

(75) Inventors: Eiichiro Kondo, Hitachinaka; Noboru Sugiura, Mito; Yoichi Anzo, Hitachinaka; Hiroshi Watanabe, Takahagi; Junichi Shimada, Mito; Kazutoshi Kobayashi, Hitachinaka, all of (JP)

(73) Assignees: Hitachi, Ltd., Tokyo; Hitachi Car Engineering Co. Ltd., Hitachinaka, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/821,562

(22) Filed: Mar. 21, 1997

Related U.S. Application Data

(63) Continuation-in-part of application No. 08/639,105, filed on Apr. 22, 1996, now Pat. No. 5,632,259.

(30) Foreign Application Priority Data

Mar. 21, 1996 (JP) ..... 8-064092
Apr. 23, 1996 (JP) ..... 8-100764

(51) Int. Cl.[7] ..... F02P 3/02
(52) U.S. Cl. ..... 123/634; 336/98
(58) Field of Search ..... 123/634; 336/83, 336/98, 110, 165, 178, 211

(56) References Cited

U.S. PATENT DOCUMENTS

| | | | | |
|---|---|---|---|---|
| 4,903,675 | | 2/1990 | Huntzinger et al. | 123/635 |
| 5,049,205 | * | 9/1991 | Takahashi et al. | 148/111 |
| 5,129,371 | * | 7/1992 | Rosalik, Jr. | 123/90.38 |
| 5,144,935 | | 9/1992 | Taruya et al. | 123/633 |
| 5,146,906 | * | 9/1992 | Agatsuma | 123/634 |
| 5,315,982 | | 5/1994 | Ward et al. | 123/634 |
| 5,377,652 | * | 1/1995 | Noble et al. | 123/634 |
| 5,632,259 | * | 5/1997 | Kondo et al. | 123/634 |

FOREIGN PATENT DOCUMENTS

| | | |
|---|---|---|
| 0738831 A1 | 10/1996 | (EP) . |
| 2624559 A3 | 12/1988 | (FR) . |
| 62-033408 A | 2/1987 | (JP) . |
| 02-228011 A | 9/1990 | (JP) . |
| 2-228011 | 9/1990 | (JP) . |
| 05-135967 A | 5/1993 | (JP) . |

OTHER PUBLICATIONS

European Search Report for EP 97 10 4865, Jul. 15, 1999.

* cited by examiner

*Primary Examiner*—Andrew W. Dollnar
(74) *Attorney, Agent, or Firm*—Evenson, McKeown, Edwards & Lenahan PLLC

(57) ABSTRACT

An ignition apparatus is received in a plug hole which is formed by a cylinder head and a cylinder head cover of an internal combustion engine. A side core has a slit between two horizontally extending side wall ends. The side core is selected from a laminated sheet structure comprised of two grain oriented silicon steel sheets, each having a slit between two horizontally extending side wall ends, and the plural slits align at substantially the same position. The slit prevents a one-turn short of a magnetic flux of the side core. Thereby a predetermined secondary voltage more than an engine requirement secondary voltage is obtained. An ignitor reception portion has an independent and individual ignitor reception portion and an independent and individual coil reception portion, with the ignitor reception portion and the coil reception portion being combined.

15 Claims, 15 Drawing Sheets

IGNITION APPARATUS FOR USE IN INTERNAL COMBUSTION ENGINE

This application is a continuation-in-part of application Ser. No. 08/639,105, filed Apr. 22, 1996, now U.S. Pat. No. 5,632,259, issued May 27, 1997.

BACKGROUND OF THE INVENTION

This application claims the priority of 8-64092 and 8-100764, the disclosures of which are expressly incorporated by reference herein.

The present invention relates to an ignition apparatus for use in an internal combustion engine and more particularly relates to a cylindrical form ignition apparatus for use in an internal combustion engine which is received in a plug hole portion of the internal combustion engine.

The present invention relates to a cylindrical form ignition apparatus for use in an internal combustion engine comprising a cylindrical form side core having a slit between vertical side wall ends. This side core having the slit is constituted by a material selected one from a single grain oriented silicon steel sheet, a single grain non-oriented silicon steel sheet, a laminated structure of at least two comprised of a grain oriented silicon steel sheet and a grain non-oriented silicon steel sheet, and a laminated structure of at least two grain oriented silicon steel sheets.

The present invention further relates to a cylindrical form ignition apparatus for use in an internal combustion engine having a reception body comprised of an ignitor case part and a coil case part. The reception body comprises an independent and individual ignitor reception portion for receiving the ignitor case part having a connector and an independent and individual coil reception portion for receiving the coil case part.

The present invention still further relates to an ignition apparatus for use in an internal combustion engine, particularly to a sealing structure of a cylindrical form ignition apparatus which is received in a plug hole portion of the internal combustion engine.

In a conventional ignition apparatus for use in an internal combustion engine, for example, as shown in Japanese laid-open patent publication No. 228,011/1990, a side core of the ignition apparatus is formed in a spiral form by multiplex winding and laminating with a single grain non-oriented silicon steel sheet to an outer case of the ignition apparatus. The side core includes the grain non-oriented silicon steel sheet of having silicon of 6.5 wt % degree and the grain non-oriented silicon steel sheet having a sheet thickness of 0.1 mm.

However, in the above stated conventional ignition apparatus, the ignition apparatus requires much time for manufacturing the side core in the spiral form and results in a high cost ignition apparatus for use in the internal combustion engine.

Further, the side core structure in the above stated conventional ignition apparatus overlaps multiply and completely the entire outside periphery portion of the outer case. In other words, the side core structure forms no gap or no space on the outside periphery portion of the outer case toward an outside periphery horizontal direction of the outer case.

As a result, the conventional ignition apparatus has a low secondary voltage, and according to the circumferences the conventional ignition apparatus cannot obtain a necessary secondary voltage with the result that the ignition apparatus cannot spark with certainty to the internal combustion engine.

In the above stated conventional ignition apparatus, regardless of a material or a length of a cylinder head or a cylinder head cover of the internal combustion engine in which a plug hole portion for receiving the ignition apparatus is formed, the side core is wound round to have substantially the same cross-sectional area of a center core.

Further, in the above stated Japanese laid-open patent publication No. 228,011/1990, the ignition apparatus has two magnets provided on both ends of the center core. These magnets generate in a magnetic path an opposite side direction magnetic flux against a magnetic flux generated by a primary coil. As a result, a high cost ignition apparatus for use in the internal combustion engine results.

In a conventional cylindrical form ignition apparatus for use in an internal combustion engine, the ignition apparatus has an outer case, and an ignitor case part (IC package type unit) and a cylindrical form ignition apparatus main body are embodied as an integral body. A connector is integrally formed to the ignitor case part and is adjacently arranged to an upper portion of the ignitor case part.

In the above stated conventional ignition apparatus, in the situation where the ignition apparatus is a type where the ignition apparatus main body is received in a plug hole (in generally, a diameter of 23–25 mm), from an aspect of a size dimension, the outer case of an ignitor reception portion projects toward an upper portion of the plug hole. Further, the outer case of the ignitor reception portion has a complicated form having a step portion.

As a result, an accuracy in a cylindrical size dimension of a coil reception portion can not be obtained, or because the connector is arranged on the upper portion of the ignitor case part, the entire length of the ignition apparatus is increased.

Further, because the ignition apparatus is arranged adjacent a combustion chamber of an internal combustion engine, an environment temperature in the plug hole reaches to 150° C. at maximum. Therefore, the ignition apparatus must not be sensitive to a severe heat resistance environment condition.

On the other hand, with respect to the connector structure, the connector cannot be affected by a shock force. Such a shock force is added during an mounting time and an installing time, or during a maintenance time of the ignition apparatus.

Therefore, the ignition apparatus requires a connector having a different specification corresponding to kind of the internal combustion engine and the kind of a control apparatus.

In a conventional ignition apparatus for use in an internal combustion engine, a sealing structure of the ignition apparatus has a sealing rubber member which prevents water leakage from a plug hole portion to a cylinder head cover of the internal combustion engine. The sealing rubber member is received fully in an interior portion of the plug hole portion and the received rubber portion of the sealing rubber member seals at a radial direction of the plug hole portion.

SUMMARY OF THE INVENTION

An object of the present invention is to provide an ignition apparatus for use in an internal combustion engine wherein an effective magnetic flux of a center core portion can pass with the most efficiency.

Another object of the present invention is to provide an ignition apparatus for use in an internal combustion engine wherein a floating capacity generated between a secondary coil and a side core can be rationally deleted.

A further object of the present invention is to provide an ignition apparatus for use in an internal combustion engine wherein a thickness or a length of a side core can vary in accordance with a material and a length of a cylinder head or a cylinder head cover of the internal combustion engine in which a plug hole portion for receiving the ignition apparatus is formed.

A further object of the present invention is to provide an ignition apparatus for use in an internal combustion engine wherein the number of magnets or a thickness of a magnet inserted on one end of a center core or both ends of the center core can vary and, as a result, a low cost ignition apparatus for use in an internal combustion engine can be obtained.

A further object of the present invention is to provide an ignition apparatus for use in an internal combustion engine wherein an ignition apparatus can cope with differences in environment condition or to various required connector specifications.

A further object of the present invention is to provide an ignition apparatus for use in an internal combustion engine where an ignition apparatus having a superior high reliability can be obtained.

A further object of the present invention is to provide an ignition apparatus for use in an internal combustion engine where a position slip-off between a sealing rubber member and a plug hole portion can be securely sealed.

A further object of the present invention is to provide an ignition apparatus for use in an internal combustion engine where a position slip-off between a sealing rubber member and a plug hole portion can be securely sealed.

According to the present invention, an ignition apparatus for use in an internal combustion engine comprises a center core, a primary coil wound round on a primary bobbin, a secondary coil wound round on a secondary bobbin, an outer case, and a side core arranged on an outer periphery of the outer case and made by using a silicon steel sheet. The primary coil and the secondary coil are arranged between the center core and the outer case, and the ignition apparatus is received in a plug hole which is formed by a cylinder head and a cylinder head cover of the internal combustion engine.

The side core has a slit between two horizontally extending side wall ends and the slit prevents a one-turn short of a magnetic flux of the side core, thereby a predetermined secondary voltage exceeding an engine requirement secondary voltage is obtained.

So as to attain the above stated objects, according to the present invention, in case where both the cylinder head and the cylinder head cover of the internal combustion engine are made by using the aluminum material, the side core is made round in a substantially pipe form with, for example, one sheet of the single grain oriented silicon steel sheet having the sheet thickness of 0.3–0.5 mm or one sheet of the single grain non-oriented silicon steel sheet having the sheet thickness of 0.3–0.5 mm.

So as to attain the above stated objects, according to the present invention, in an instance where both the cylinder head and the cylinder head cover of the internal combustion engine are made by using the aluminum material, the side core is made round in the substantially pipe form and is laminated with, for example, two sheets or three sheets of the grain oriented silicon steel sheet having the sheet thickness of 0.3–0.5 mm per one sheet. The side core has the total sheet thickness of more than 0.6 mm or one sheet of the single grain non-oriented silicon steel sheet having the sheet thickness of 0.3–0.5 mm and at least one sheet of the grain oriented silicon steel sheet having the sheet thickness of 0.3–0.5 mm per one sheet, and then the side core has the total sheet thickness of more than 0.6 mm.

In both the above instances, the upper end of the side core positions is substantially the same as the upper end of the cylinder head cover, or the upper end of the side core positions is lower than the upper end of the center core.

In an instance where the cylinder head of the internal combustion engine is made by using aluminum material and the cylinder head cover of the internal combustion engine is made by using thermoplastic synthetic resin material (for example, polypropylene, nylon 6, nylon 66, nylon 12, etc.), the side core is made round in a substantially pipe form, for example, one sheet of the single grain oriented silicon steel sheet having a sheet thickness of 0.3–0.5 mm or one sheet of the single grain non-oriented silicon steel sheet having a sheet thickness of 0.3–0.5 mm.

In another instance where the cylinder head of the internal combustion engine is made by using aluminum material and the cylinder head cover of the internal combustion engine is made by using thermoplastic synthetic resin material (for example, polypropylene, nylon 6, nylon 66, nylon 12, etc.), the side core is made round in the substantially pipe form and is laminated with, for example, two sheets or three sheets of the grain oriented silicon steel sheet having a sheet thickness of 0.3–0.5 mm per one sheet and then the side core has the total sheet thickness of more than 0.6 mm or one sheet of the single grain non-oriented silicon steel sheet having a sheet thickness of 0.3–0.5 mm and at least one sheet of the grain oriented silicon steel sheet having a sheet thickness of 0.3–0.5 mm per one sheet and then the side core has a total sheet thickness of more than 0.6 mm.

In both of the above instances, the upper end of the side core positions substantial same to the upper end of the cylinder head, or the upper end of the side core positions lower than the upper end of the center core.

In the instance where the cylinder head of the internal combustion engine is made by using aluminum material and the cylinder head cover of the internal combustion engine is made by using thermoplastic synthetic resin material (for example, polypropylene, nylon 6, nylon 66, nylon 12, etc.), and in case where the iron made plug tube is inserted under pressure in the plug hole portion of the internal combustion engine, the side core is made round in the substantially pipe form, for example, one sheet of the single grain oriented silicon steel sheet having a sheet thickness of 0.3–0.5 mm or one sheet of the single grain non-oriented silicon steel sheet having a sheet thickness of 0.3–0.5 mm.

In another instance where the cylinder head of the internal combustion engine is made by using aluminum material and the cylinder head cover of the internal combustion engine is made by using thermoplastic synthetic resin material (for example, polypropylene, nylon 6, nylon 66, nylon 12, etc.), and where the iron made plug tube is inserted under pressure in the plug hole portion of the internal combustion engine, the side core is made round in the substantially pipe form, two sheets or three sheets of the grain oriented silicon steel sheet having a sheet thickness of 0.3–0.5 mm per one sheet and then the side core has a total sheet thickness of more than 0.6 mm or one sheet of the grain non-oriented silicon steel sheet having a sheet thickness of 0.3–0.5 mm and at least one sheet of the grain oriented silicon steel sheet having a sheet thickness of 0.3–0.5 mm per one sheet and then the side core has a total sheet thickness of more than 0.6 mm.

In both of the above instances, the upper end of the side core positions is substantially the same as the higher upper end selected one from the upper end of the cylinder head and the upper end of the iron made plug tube, or the upper end of the side core positions is lower than the upper end of the center core.

The magnet generates in the magnetic path the opposite side direction magnetic flux against the magnetic flux generated by the primary coil, and the magnet is provided on one end of the center core or on both ends of the center core.

In instances where both the cylinder head and the cylinder head cover are made by using aluminum material with the magnet inserted on both ends of the side core, magnetic flux can be generated with high efficiency.

If the cylinder head is made by using aluminum material and the cylinder head cover is made by using thermoplastic synthetic resin material, by inserting the magnet on one end of the center core, magnetic flux can be generated with high efficiency.

In the above instance, the magnetic flux can be generated with higher efficiency by inserting the magnet to the center core at the side of the aluminum cylinder head rather than the side of the thermoplastic synthetic resin material cylinder head cover, thereby a low cost ignition apparatus for use in an internal combustion engine can be obtained.

According to the present invention, an ignition apparatus for use in an internal combustion engine comprises a center core, a primary coil wound round on a primary bobbin, a secondary coil wound round on a secondary bobbin, an outer case, a side core arranged on an outer periphery of the outer case, and a reception body for receiving an ignitor case part and a coil case part. The ignitor case part has an electrically and adjacently arranged connector, and the primary coil and the secondary coil are arranged between the center core and the outer case.

The ignitor reception portion comprises an independent and individual ignitor reception portion and an independent and individual coil reception portion, and the ignitor reception portion and the coil reception portion are combined.

According to the present invention, an ignition apparatus for use in an internal combustion engine comprises a center core, a primary coil wound round on a primary bobbin, a secondary coil wound round on a secondary bobbin, an outer case, a side core arranged on an outer periphery of the outer case, a reception body for receiving an ignitor case part and a coil case part. The ignitor case part has an electrically and adjacently arranged connector, and a sealing member for sealing an environment of an inside and an outside of a plug hole portion of the internal combustion engine. The primary coil and the secondary coil are arranged between the center core and the outer case.

The ignitor reception portion comprises an independent and individual ignitor reception portion and an independent and individual coil reception portion. The ignitor reception portion receives the ignitor case part at a portion where the sealing member fits into and inserts, and the ignitor reception portion and the coil reception portion are combined.

The objects according to the present invention are attained by an ignition apparatus for use in an internal combustion engine comprising an ignitor part having an electrically connected and adjacently arranged connector, a coil case part, and a reception body for receiving the ignitor part and the coil case part.

The ignition apparatus for use in the internal combustion engine comprises a reception body having two parts comprised of an independent and individual coil reception portion, and an independent and individual ignitor reception portion. The coil reception portion receives the coil case part and is inserted into a standardized plug hole of an internal combustion engine. The ignitor reception portion receives the ignitor case part and is arranged at outside of the plug hole and has the connector which can connect to the other connector having a different specification.

The coil reception portion and the ignitor reception portion are integrally combined at a combination portion.

Further, another essential feature according to the present invention is an ignition apparatus for use in an internal combustion engine, comprising an ignitor case part having an electrically connected and adjacently arranged connector, a coil case part, a reception body for receiving the ignitor case part and the coil case part, and a sealing body for sealing the inside and outside of an internal combustion engine plug hole, which fits into and inserts into the reception body.

The ignition apparatus for use in the internal combustion engine comprises the reception body having two part comprised of an independent and individual coil reception portion, and an independent and individual ignitor reception portion at a portion in which the sealing body is fitted into. The coil reception portion receives the coil case part and is inserted into the plug hole, and the ignitor reception portion receives the ignitor case part and is arranged outside of the plug hole and has the connector which can connect to another connector with a different specification.

The coil reception portion and the ignitor reception portion are integrally combined at the combination portion.

According to the present invention, the ignition apparatus can cope with differences in actual mounted environment condition or various required connector specifications.

According to the present invention, an ignition apparatus for use in an internal combustion engine comprises a center core, a primary coil wound round on a primary bobbin, a secondary coil wound round on a secondary bobbin, an outer case, a side core arranged on an outer periphery of the outer case. The primary coil and the secondary coil are arranged between the center core and the outer case, and the ignition apparatus is received in a plug tube and a plug hole portion which is formed by a cylinder head, and a cylinder head cover of the internal combustion engine. An ignition plug is arranged at a lower portion of the plug hole portion. The ignition apparatus further comprises an inner cylindrical portion inserted to the plug hole and a sealing rubber member inserted and fitted into the inner cylindrical portion of the ignition apparatus so as to prevent water penetration into the plug hole.

The sealing rubber comprises a flange portion and a conical portion. The flange portion of the sealing rubber member has an extension face at a radial direction, the extension face contacts to a tip end portion of the cylinder head cover from an axial direction side and enable to bend at the axial direction side and to escape a radial direction slip-off, and the conical portion of the sealing rubber member forms a tapering form toward at a direction of the ignition plug so as to guide the sealing rubber member, when the conical portion of the sealing rubber member is inserted into the plug tube.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWING

Figure 1:
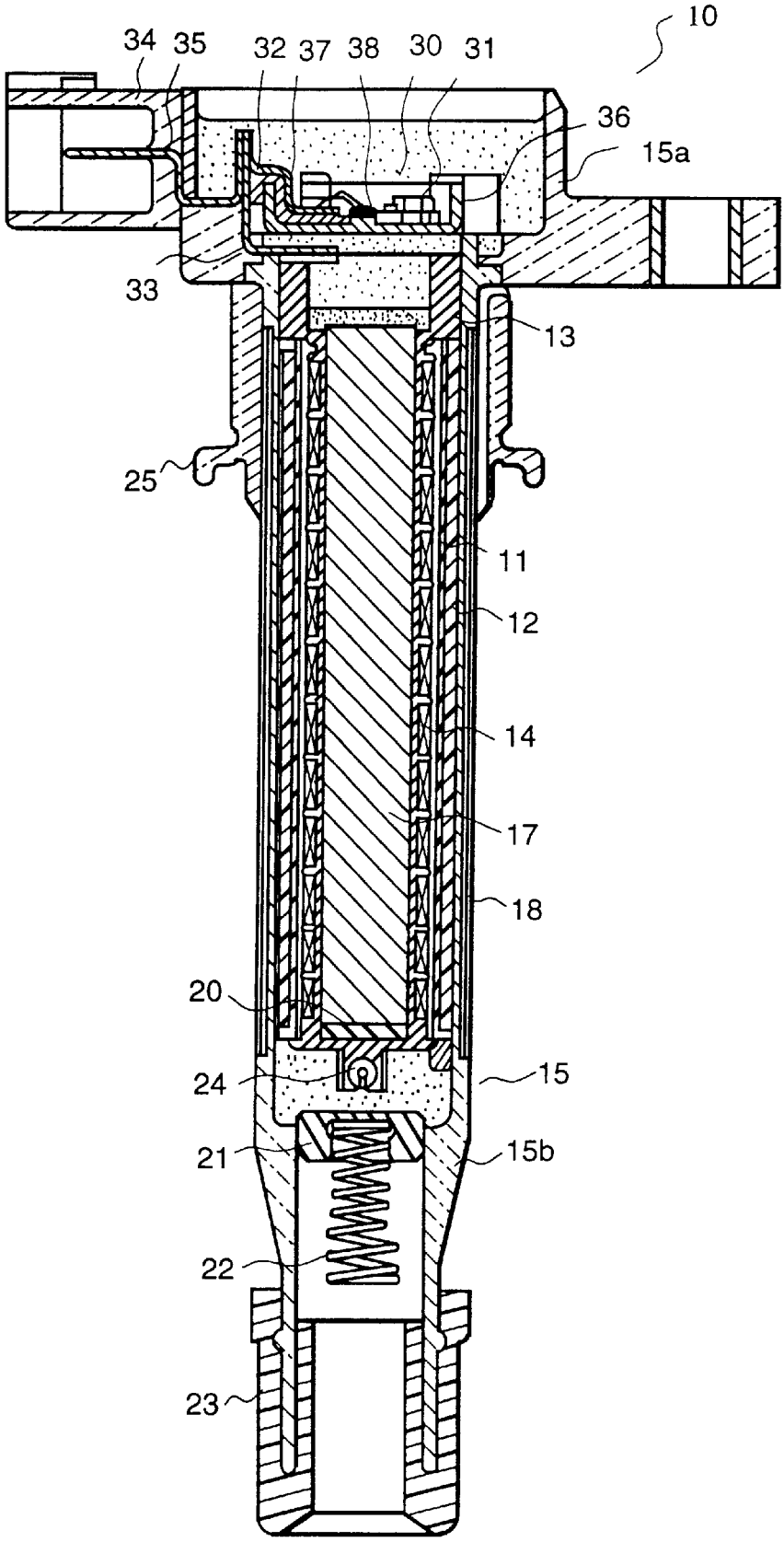
FIG. 1 is a cross-sectional view showing one embodiment of an ignition apparatus for use in an internal combustion engine according to the present invention.

Hereinafter, one embodiment of an ignition apparatus for use in an internal combustion engine according to the present invention will be explained referring to FIG. 1 and FIG. 2.

An ignition apparatus (an ignition coil) 10 for use in an internal combustion engine mainly comprises a primary bobbin 11, a primary coil 12, a secondary bobbin 13, a secondary coil 14, an outer case 15, an epoxy resin material member 16, a center core (an open magnetic path iron core) 17, a side core (an outer iron core) 18, and a flexible epoxy resin material member 19.

The ignition apparatus (ignition coil) 10 comprises further a magnet 20 arranged at a lower end of the primary bobbin 11, a high voltage terminal 21, a spring member 22, a rubber boot member 23, an advance spark ignition prevention high voltage diode 24, a sealing rubber member 25, and an ignitor unit 30.

The ignitor unit 30 has a copper or aluminum made box form metal base 36, and this metal base 36 installs a power transistor chip 31 and a hybrid IC circuit 38. An ignitor terminal 32 is adhered to a terminal stand 37 which is integrally formed with the metal base 36 thorough an adhesive agent 39. The ignitor terminal 32 is connected to a primary coil terminal 33 and a connector side terminal 35. The ignitor unit 30 has a connector 34.

The center core 17 is arranged at a center portion of the ignition apparatus 10, and this center core 17 is constituted by laminating, under pressing operation, a grain oriented silicon steel sheet. The primary bobbin 11 fits onto an outer periphery of the center core 17, and the primary coil 12 comprised of an enamel wire, etc. is wound round an outer periphery of the primary bobbin 11.

The secondary bobbin 13 fits into the primary bobbin 11. The plural divided secondary coil 14 is wound round the secondary bobbin 13 at a predetermined interval. The outer case 15 is wound round at an outer periphery of the secondary bobbin 13.

The outer case 15 comprises an ignitor case part 15*a* and a coil case part 15*b* which has a vertically extending projection member 15*b*1 at an outer portion. The side core 18 is arranged outside of the coil case part 15*b* of the outer case 15.

The side core 18 comprises a laminated structure of two silicon steel sheets 18*a*, 18*b* which are an inner silicon steel sheet 18*a* and an outer silicon steel sheet 18*b*. Each of the two silicon steel sheets 18*a*, 18*b* is made by using a single grain oriented silicon steel sheet.

The inner sheet 18*a* of the side core 18 is made by using the single grain oriented silicon steel sheet having a sheet thickness of 0.35 mm. The inner sheet 18*a* is formed in a substantially pipe form having a vertically extending slit 18*a*1. This inner sheet 18*a* fits into the outer periphery of the outer case 15, and the slit 18*a*1 of the inner sheet 18*a* is positioned between a projection member 15*b*1 of the coil case part 15*b*. This projection member 15*b*1 of the coil case part 15*b* is not necessarily provided on the coil case part 15*b*.

The outer sheet 18*b* of the side core 18 is made by using the single grain oriented silicon steel sheet having a sheet thickness of 0.35 mm. The outer steel 18*b* is formed in substantially a pipe form having a vertically extending slit 18*b*1. This outer sheet 18*b* is laminated and overlapped on an outer periphery of the inner sheet 18*a*.

Accordingly, a laminated structure of the side core 18 having a total sheet thickness of 0.7 mm comprised of the inner sheet 18*a*, with the outer sheet 18*b* fitted to the outside periphery of the outer case 15 and the slit 18*b*1 of the outer sheet 18*b* positioned between the projection member 15*b*1 of the coil case part 15*b*.

In other words, in this embodiment of the ignition apparatus 10 according to the present invention, the laminated structure of the side core 18 comprised of the inner sheet 18*a* and the outer sheet 18*b* forms a gap (a space) g between the vertical side wall ends of the inner sheet 18*a* having the slit 18*a*1 and between the vertical side wall ends of the outer sheet 18*b* having the slit 18*b*1.

The slit 18*a*1 of the inner sheet 18*a* for forming the gap g and the slit 18*b*1 of the outer sheet 18*b* for forming the gap g can be separated electrically by the projection member 15*b*1 of the coil case part 15*b*, and the slits 18*a*1 and 18*b*1 of the side core 18 prevent a one-turn short of a magnetic flux.

Now, with respect to the grain oriented silicon steel sheet and the grain non-oriented steel sheet employed for the side core 18 of the ignition apparatus 10, the established commercial kinds of the sheet thickness of the silicon steel sheet are 0.23 mm, 0.3 mm, 0.35 mm and 0.5 mm.

In particular, in the present invention, as a single sheet structure a single silicon steel sheet having a sheet thickness of 0.5 mm can be employed, and a laminated sheet structure of two silicon steel sheets having a sheet thickness of 0.35 mm (in a total sheet thickness is 0.7 mm) can be employed.

The primary bobbin 11 is manufactured by using a thermoplastic synthetic resin material, for example, denatured polyphenylene oxide (hereinafter, "denatured PPO" etc.).

To prevent an occurrence of an insulation destruction in which an electric field concentration occurs by peeling off the epoxy resin material member 16 for insulating between the primary bobbin 11 and a high voltage after a thermal shock test, the primary bobbin 11 is made of the denatured PPO, taking into consideration an adhesion characteristic with the epoxy resin material member 16.

Because the ignition apparatus 10 for use in the internal combustion engine according to the present invention is installed to a plug hole portion of the internal combustion engine, it is preferable to use a thermal deformation temperature of the denatured PPO of more than 150° C. as the material for the primary bobbin 11.

Figure 4A:
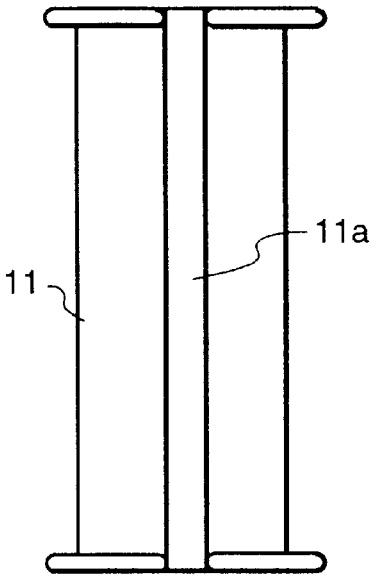
FIG. 4A is a side view showing a primary bobbin structure having grooves or notches of an ignition apparatus for use in an internal combustion engine according to the present invention.
Figure 4B:
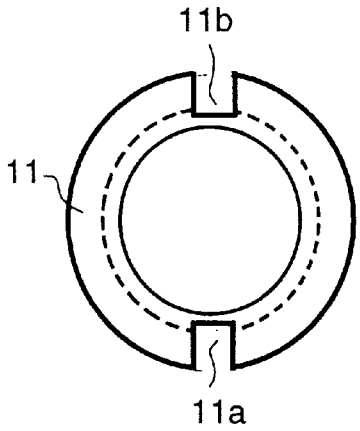
FIG. 4B is a plan view showing the primary bobbin having the grooves of FIG. 4A.

Further, as shown in FIG. 4A and FIG. 4B, two vertically extending grooves (notches) 11*a*, 11*b* are provided on the primary bobbin 11, and each of the grooves 11*a*, 11*b* has a depth of 0.1–0.5 mm to easily impregnate the high voltage insulation epoxy resin material member 16 in a winding portion of the primary coil 12.

The primary coil 12 is laminated and wound round with a total 100–300 times degree enamel wire having a diameter of 0.3–1.0 mm. This enamel wire is laminated and wound round extending in several layers in which each extending layer comprises several ten times.

The secondary bobbin 13 is a thermoplastic synthetic resin material (for example, the denatured PPO etc.), and the secondary coil 14 is wound round on the secondary bobbin 13. The secondary bobbin 13 is arranged between the center core 17 and the secondary coil 14, and the secondary bobbin 13 functions as an insulation of the high voltage generated in the secondary coil 14.

Herein, because the center core 17 floats with the ground (GND), the center core 17 has an intermediate potential of the voltage generated in the secondary coil 14. To insulate a potential difference between the center core 17 and the secondary coil 14, the secondary bobbin 14 has a thickness of 0.5–1.2 mm.

Further, to prevent an electric field concentration between the secondary coil 14 and the center core 17, the flexible epoxy resin material member 19 is poured under vacuum condition in an inside portion of the secondary bobbin 13. The secondary coil 14 is formed by using the enamel wire having a wire diameter of 0.03–0.06 mm and is dividingly wound round with total 10,000–30,000 times.

The outer case 15 is a thermoplastic synthetic resin material (for example, polybutylene terephthalate (hereinafter, "PBT") or polyphenylene sulfide (hereinafter, "PPS"), etc.

The outer case 15 has a gate at a side of the high voltage, and then an occurrence in voids at the side of the high voltage can be prevented. The center core 17 is laminated under pressing operation with a grain oriented silicon steel sheet having a sheet thickness of 0.2–0.7 mm per one sheet.

Where the ignition apparatus (ignition coil) 10 mounts on the plug hole portion of the internal combustion engine, the side core 18 and the magnet 20, which is provided on a lower portion of the center core 17, are arranged to pass an effective magnetic flux $\phi x$ of the center core 17 portion at maximum and to delete rationally a floating capacity C generated between the secondary coil 14 and the side core 18.

Figure 5:
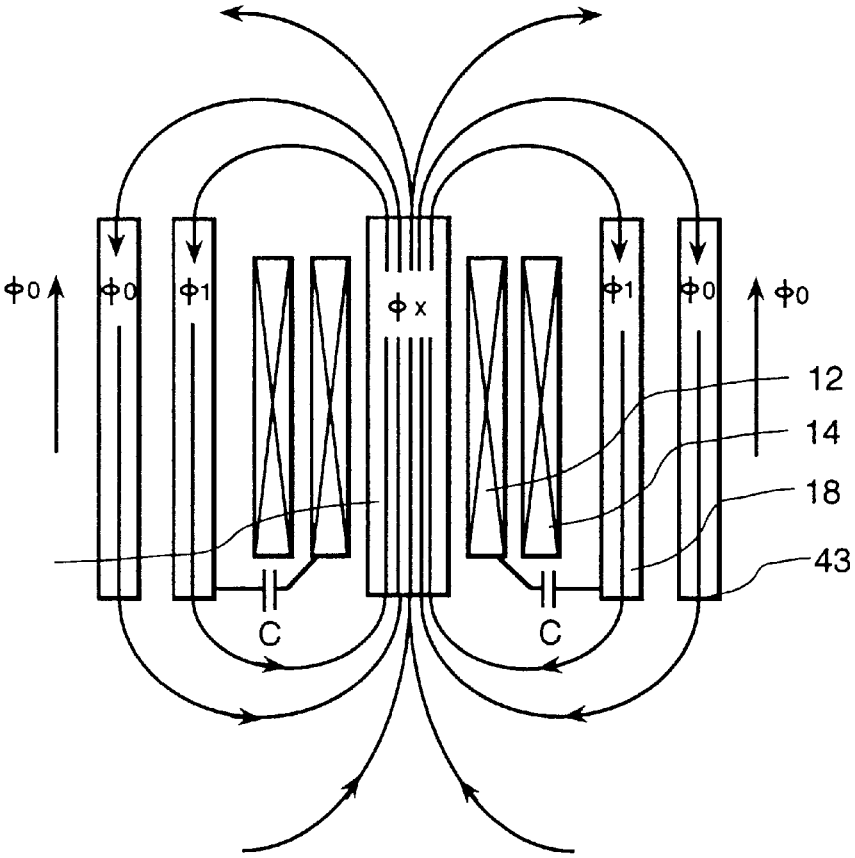
FIG. 5 is a flow diagram showing a magnetic flux where an ignition apparatus for use in an internal combustion according to the present invention is mounted on the internal combustion engine.

As shown in FIG. 5, when the ignition apparatus 10 mounts on the plug hole portion of the internal combustion engine, the effective magnetic flux $\phi x$ is divided into a magnetic flux $\phi 1$ of the side core 18 portion and a magnetic flux $\phi 0$ of the plug hole portion of the internal combustion engine.

According to the magnetic flux $\phi 0$ of the plug hole portion of the internal combustion engine, the head cover having the one turn short part of the internal combustion engine is an aluminum material, a relationship between the thickness of the side core 18 and a secondary voltage of the ignition apparatus (ignition coil) 10 being shown as following.

$$\phi x \approx \phi 1 + \phi 0$$

$$V_2 \approx N \times d\phi x/dt$$

$$V_{2'} \approx N \times d(\phi x - \phi 0)/dt$$

wherein, $V_2$ is a secondary voltage of a single ignition apparatus; and $V_{2'}$ is a secondary voltage of the ignition apparatus mounted on the internal combustion engine.

In this embodiment of the ignition apparatus 10 according to the present invention, because the side core 18 is formed by laminating with two grain oriented silicon steel sheets having a sheet thickness of 0.35 mm per one sheet and then having the side core 18 with a total sheet thickness of 0.7 mm being formed on the outer case 15, as a result, an engine requirement secondary voltage can be exceeded.

Figure 6:
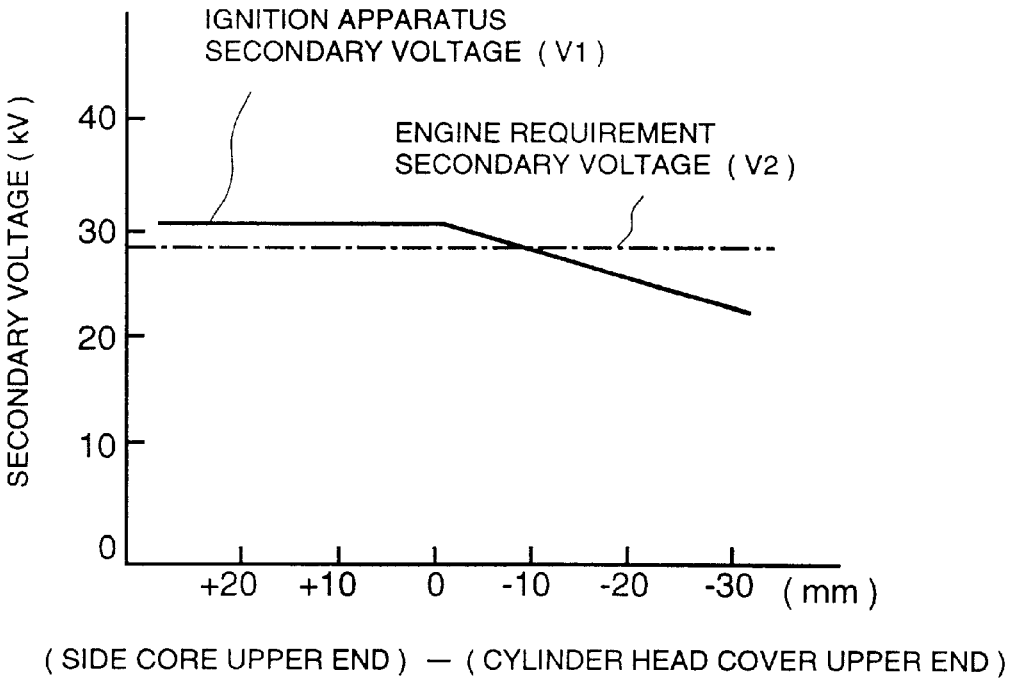
FIG. 6 is a graph showing the relationship between a length of a side core and a secondary voltage of an ignition apparatus for use in an internal combustion engine according to the present invention.

FIG. 6 shows a relationship between the length of the side core 18 and the secondary voltage of the ignition apparatus 10 where both a cylinder head and a cylinder head cover of the internal combustion engine are made of aluminum material.

As shown in FIG. 6, it was found desirable to position, for example, an upper end portion of the side core 18 more than an upper end portion of the cylinder head cover of the internal combustion engine in which the plug portion forms.

Namely, the upper end portion of the side core 18 should be positioned more than the upper end portion of the cylinder head cover, or the upper end portion of the side core 18 should be positioned less than about 10 mm of the upper end portion of the cylinder head cover.

With the above state construction, because the secondary voltage (V1) of the ignition apparatus 10 has more than the engine required secondary voltage (V2), a good spark condition in the ignition apparatus (ignition coil) 10 for sparking surely to the internal combustion engine is obtainable.

Figure 7:
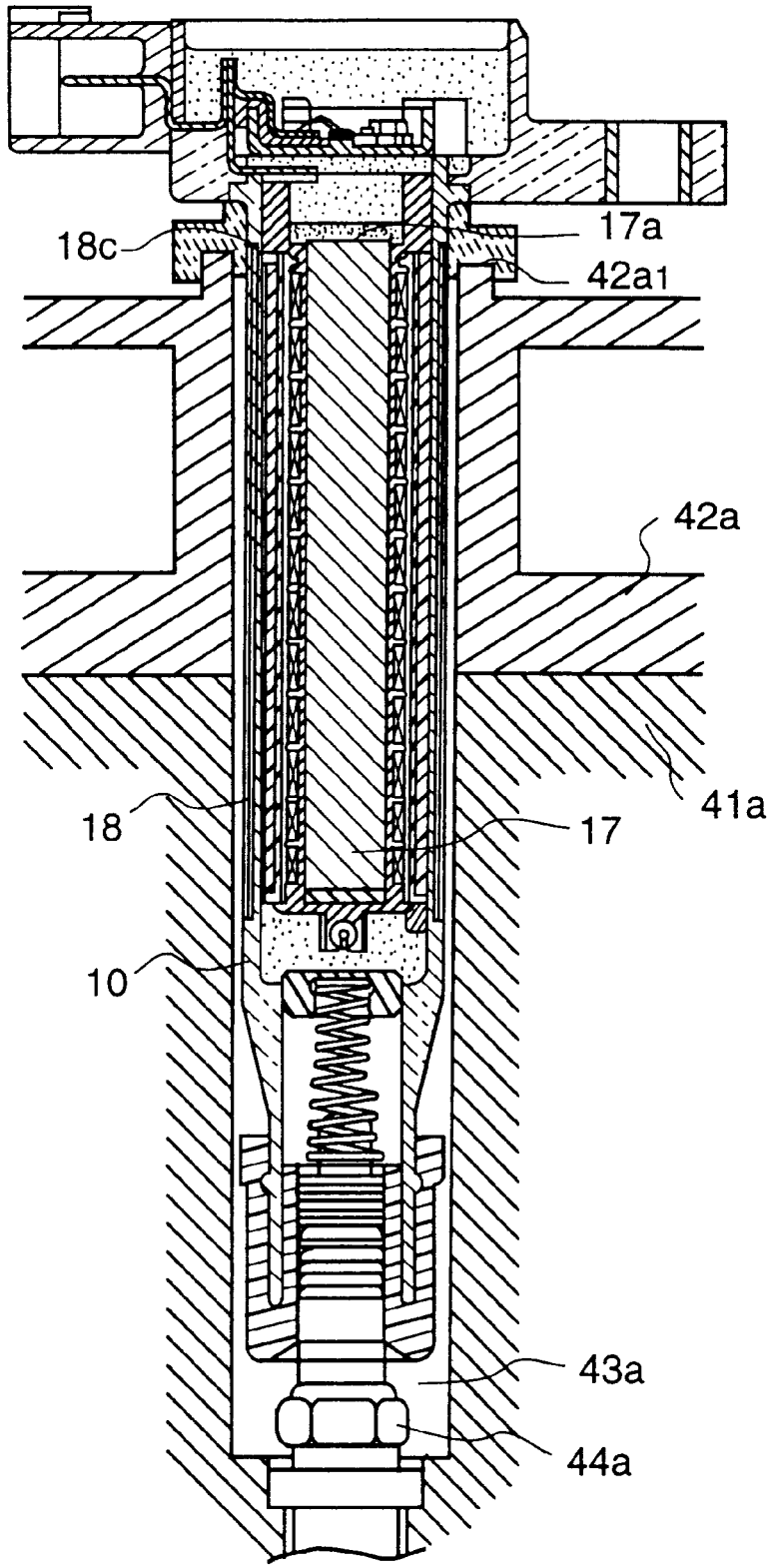
FIG. 7 is a cross-sectional view showing an ignition apparatus for use in an internal combustion engine according to present invention where both a cylinder head and a cylinder head cover of the internal combustion engine are made from an aluminum material.

In FIG. 7, an aluminum cylinder head 41*a* and an aluminum cylinder head cover 42*a* form a plug hole portion 43*a* which receives the ignition apparatus (ignition coil) 10. An ignition coil 44*a* is arranged at a lower portion of the ignition apparatus 10.

Where an upper end 18*c* of the side core 18 is the same or higher than an upper end of an upper end 42*a*1 of the cylinder head cover 42*a* of the internal combustion engine, the secondary voltage of the ignition apparatus 10 does not vary.

However, where the upper end 18*c* of the side core 18 is lower than the upper end 42*a*1 of the cylinder head cover 42*a* of the internal combustion engine, the secondary voltage of the ignition apparatus 10 is lowered.

The notch (the slit 18*a* or the slit 18*b*) is provided on at least one portion of a circumferential periphery of the side core 18, and this notch 18*a* or 18*b* can prevent the one-turn short.

Herein, where both the cylinder head 41*a* and the cylinder head cover 42*a* are aluminum material, the side core 18 is formed round in a substantially pipe form and by laminating with two sheet or three sheet of a grain oriented silicon steel plate having a sheet thickness of 0.3–0.5 mm per one sheet, and then the side core 18 formed in the laminated structure has a total sheet thickness of more than 0.6 mm.

The upper end 18*c* of the side core 18 is positioned substantially the same as the upper end 42*a*1 of the cylinder head cover 42*a*, or the upper end 18*c* of the side core 18 is positioned lower than an upper end 17*a* of the center core 17.

Figure 8:
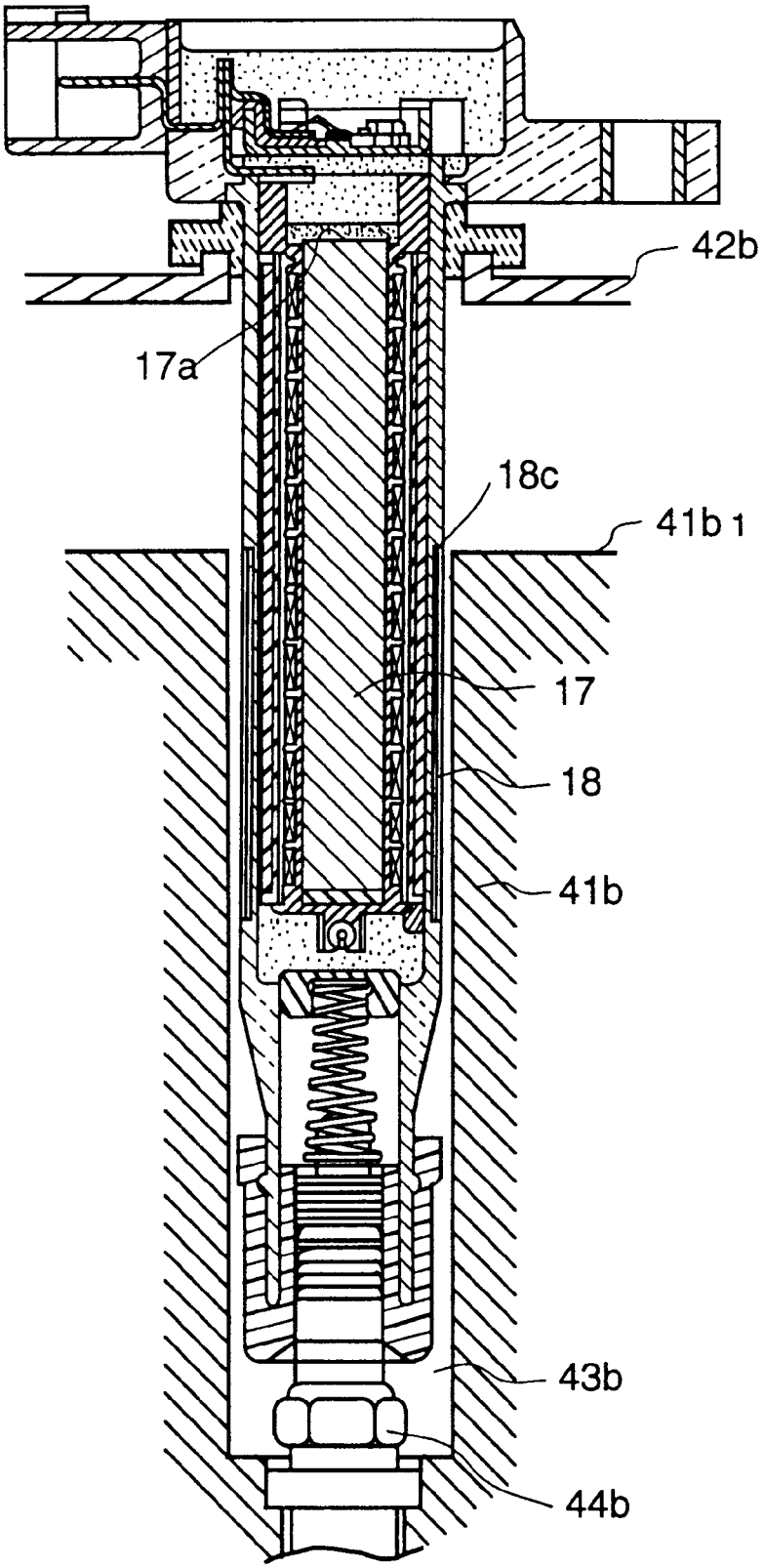
FIG. 8 is a cross-sectional view showing an ignition apparatus for use in an internal combustion engine according to present invention where a cylinder head of the internal combustion engine is made from an aluminum material and a cylinder head cover of the internal combustion engine is made from a thermoplastic synthetic resin material.

In FIG. 8, an aluminum cylinder head 41*b* and a thermoplastic synthetic resin cylinder head cover 42*b* form a plug hole portion 43*b* which receives the ignition apparatus (ignition coil) 10. An ignition coil 44*b* is arranged at a lower portion of the ignition apparatus 10.

When the cylinder head 41*b* is aluminum material and the cylinder head cover 42*b* is thermoplastic synthetic resin material (for example, polypropylene, nylon 6, nylon 66, nylon 12, etc.), the side core 18 is formed round in a substantially pipe form with one sheet or two sheets of a grain oriented silicon steel sheet having a sheet thickness of 0.3–0.5 mm per one sheet, and then the side core 18 is formed by the single grain oriented sheet or by a laminated structure having a total sheet thickness of more than 0.6 mm.

The upper end 18*c* of the side core 18 is positioned substantial the same as an upper end 42*b*1 of the cylinder head 4*b*, or the upper end 18*c* of the side core 18 is positioned lower than the upper end 17*a* of the center core 17.

Figure 9:
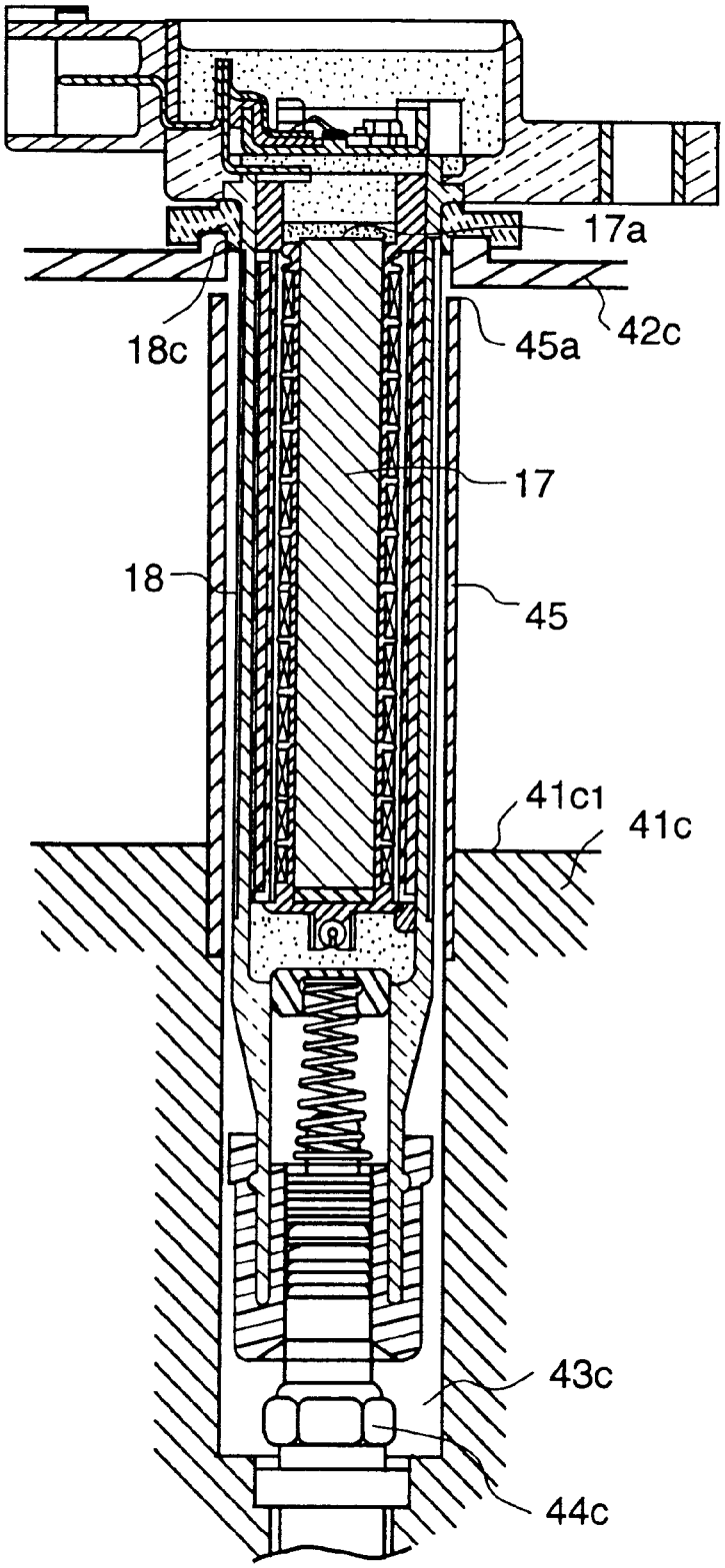
FIG. 9 is a cross-sectional view showing an ignition apparatus for use in an internal combustion engine according to present invention where a cylinder head of the internal combustion engine is made from an aluminum material, a cylinder head cover of the internal combustion engine is made from a thermoplastic synthetic resin material and an iron made plug tube is inserted into a plug hole of the internal combustion engine.

In FIG. 9, an aluminum cylinder head 41*c* and an aluminum cylinder head cover 42*c* form a plug hole portion 43*c* which receives the ignition apparatus (ignition coil) 10. An iron plug tube 45 is mounted on the cylinder head 41*c* and covers the ignition apparatus 10. An ignition coil 44*c* is arranged at a lower portion of the ignition apparatus 10.

When the cylinder head 41*c* is aluminum material, the cylinder head cover 42*c* is thermoplastic synthetic resin material (for example, polypropylene, nylon 6, nylon 66, nylon 12, etc.), and the iron plug tube 45 is inserted under pressure in the plug hole 43*c* of the internal combustion engine, the side core 18 is formed round in a substantially pipe form and laminated with one sheet of a grain non-oriented steel sheet or two sheets of a grain oriented silicon steel sheet having a sheet thickness of 0.3–0.5 mm. Then, for example, the side core 18 is formed by the single grain non-oriented silicon steel sheet having a sheet thickness of 0.5 mm, or the side core 18 is formed by the laminated structure having a total sheet thickness of more than 0.6 mm.

The upper end 18*c* of the side core 18 is positioned substantial the same as a higher upper end selected from the upper end 41*c*1 of the cylinder head 41*c* and an upper end 45*a* of the iron made plug tube 45, or the upper end 18*c* of the side core 18 is positioned lower than the upper end 17*a* of the center core 17.

Various installing techniques for the magnet 20 to the center core 17 will be explained referring to FIGS. 10A, 10B and 10C.

Figures 10A, 10B, 10C:
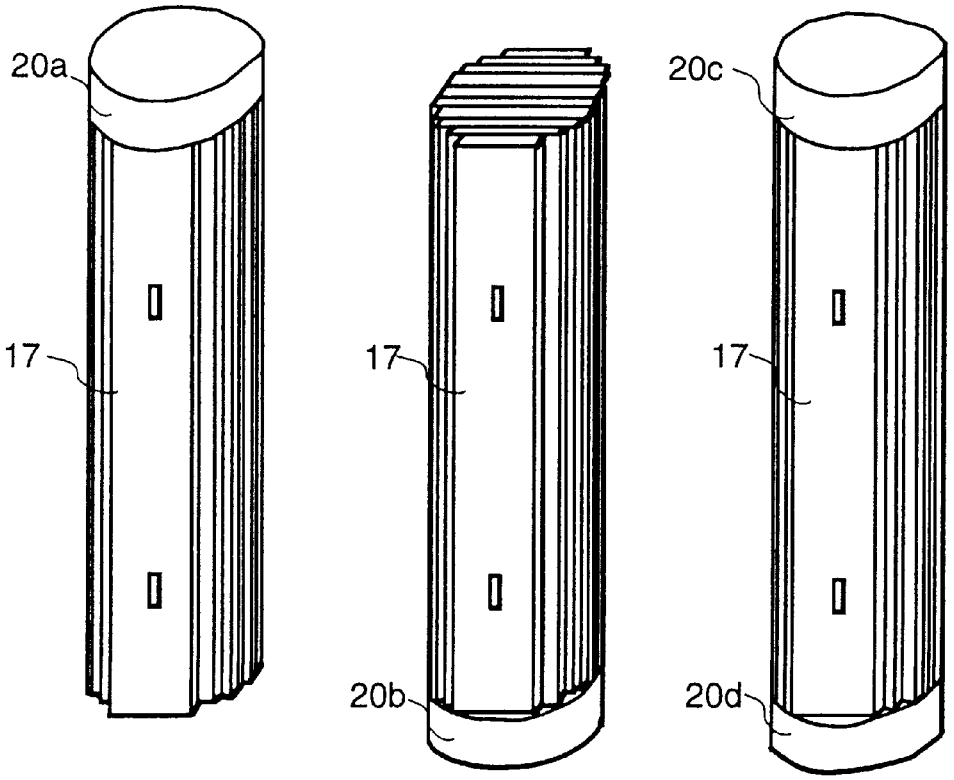
FIG. 10A is a perspective view showing one example of a positional relationship between a center core and a magnet of an ignition apparatus for use in an internal combustion engine according to the present invention where the magnet is positioned at an upper portion of the center core.
FIG. 10B is a perspective view showing another example of a positional relationship between a center core and a magnet of an ignition apparatus for use in an internal combustion engine according to the present invention where the magnet is positioned at a lower portion of the center core.
FIG. 10C is a perspective view showing a further example of a positional relationship between a center core and two magnets of an ignition apparatus for use in an internal combustion engine according to the present invention where the two magnets are positioned at an upper portion and a lower portion of the center core.

As shown in FIG. 10A, the magnet 20*a* is provided on an upper end of the center core 17. This magnet 20*a* generates in a magnetic path an opposite side direction magnetic flux against a magnetic flux formed by the primary coil 12.

As shown in FIG. 10B, a magnet 20*b* is provided on a lower end of the center core 17. This magnet 20*b* generates in a magnetic path an opposite side direction magnetic flux against a magnetic flux formed by the primary coil 12.

As shown in FIG. 10C, two magnets 20*c* and 20*d* are provided on an upper portion and a lower end of the center core 17. These magnets 20*c* and 20*d* generate in a magnetic path an opposite side direction magnetic flux against a magnetic flux formed by the primary coil 12.

When both the cylinder head and the cylinder head cover are aluminum material, insertion of the magnets 20*c*, 20*d* in the both ends of the center core 17 as shown in FIG. 10C, generates magnetic flux with high efficiency.

On the other hand, when the cylinder head is aluminum material and the cylinder head cover is thermoplastic synthetic resin material, insertion of the magnet 20*a* or the magnet 20*b* in one end of the center core 17 as shown in FIG. 10A or FIG. 10B, also generates magnetic flux with high efficiency.

In the above case, magnetic flux can be generated with high efficiency by inserting the magnet 20*a* or the magnet 20*b* on a side of the aluminum cylinder head than a side of the thermoplastic synthetic resin material made cylinder head cover of the center core 17, thereby a low cost ignition apparatus 10 for an internal combustion engine can be obtained.

Further, in the conventional ignition apparatus, an installation position of the ignition coil can not be lower than the upper end of the center core.

Figure 11:
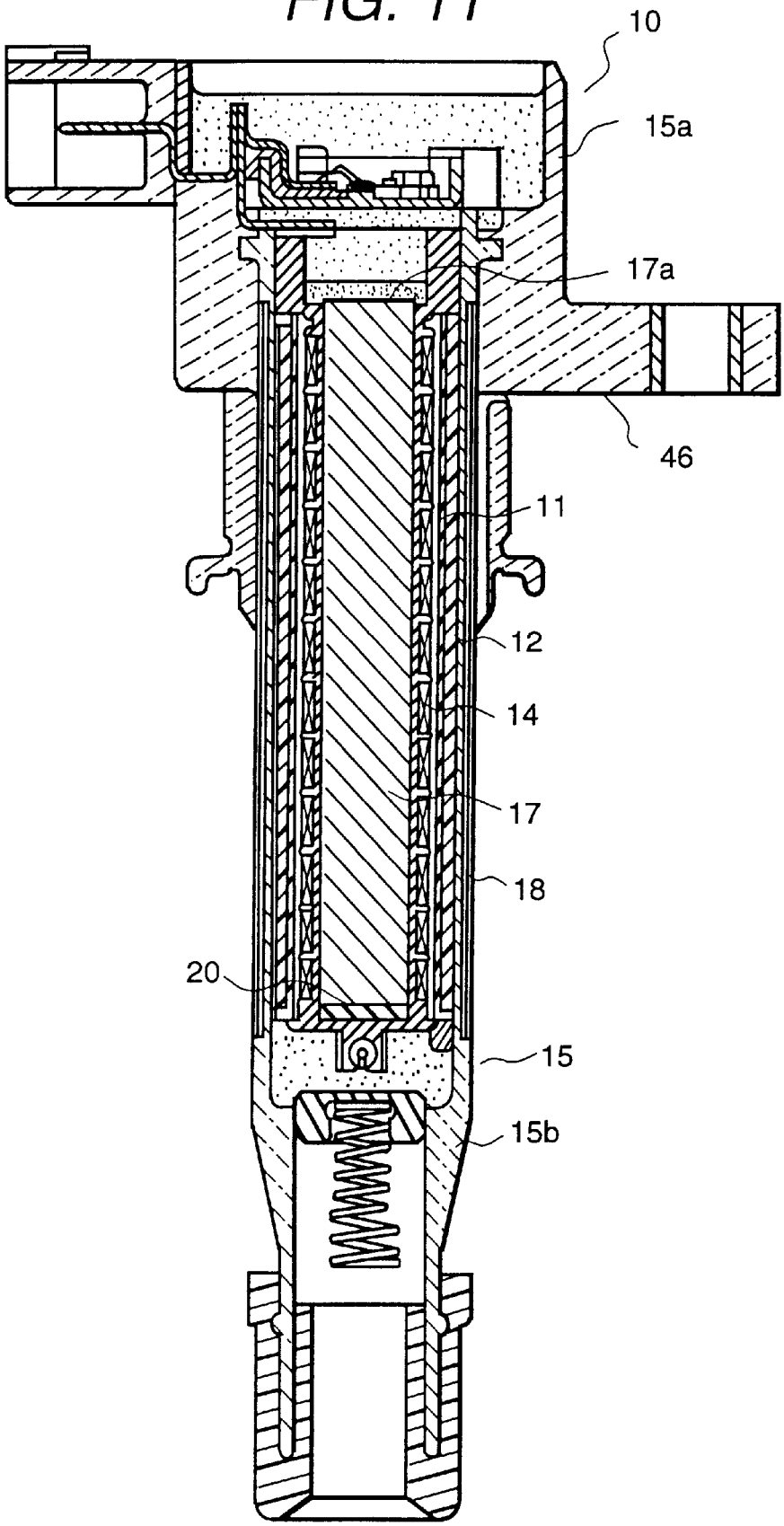
FIG. 11 is a cross-sectional view showing another embodiment of an ignition apparatus for use in an internal combustion engine according to the present invention where an installation position of an ignition apparatus is at a lower end rather than an upper end of a center core.

According to the present invention as shown in FIG. 11, however, an installation position 46 of the ignition apparatus (ignition coil) 10 can be lower than the upper end 17*a* of the center core 17.

As a result, the ignition apparatus 10 can be installed in the internal combustion engine when a short distance exists between an installation position of an ignition plug and the installation position 46 of the ignition apparatus 10.

These construction components are arranged concentrically in the order of the center core 17, the secondary coil 14, the primary coil 12, the outer case 15, and the side core 18 from the inside portion of the ignition apparatus 10.

These coil portions are inserted into the outer case 15 and insulate the high voltage by the insulation layer 16 comprised of the epoxy resin material, etc. To improve the thermal shock property (repeat test by −40° C. and 130° C., etc.) and a high voltage withstanding characteristic under high temperature, an epoxy resin material 16 having a glass transfer point of 120–162° C. after hardening and further a thermal expansion coefficient of $10–50\times10^{E-6}$ as a mean value in a temperature range less than the glass transfer temperature is employed.

Figure 12:
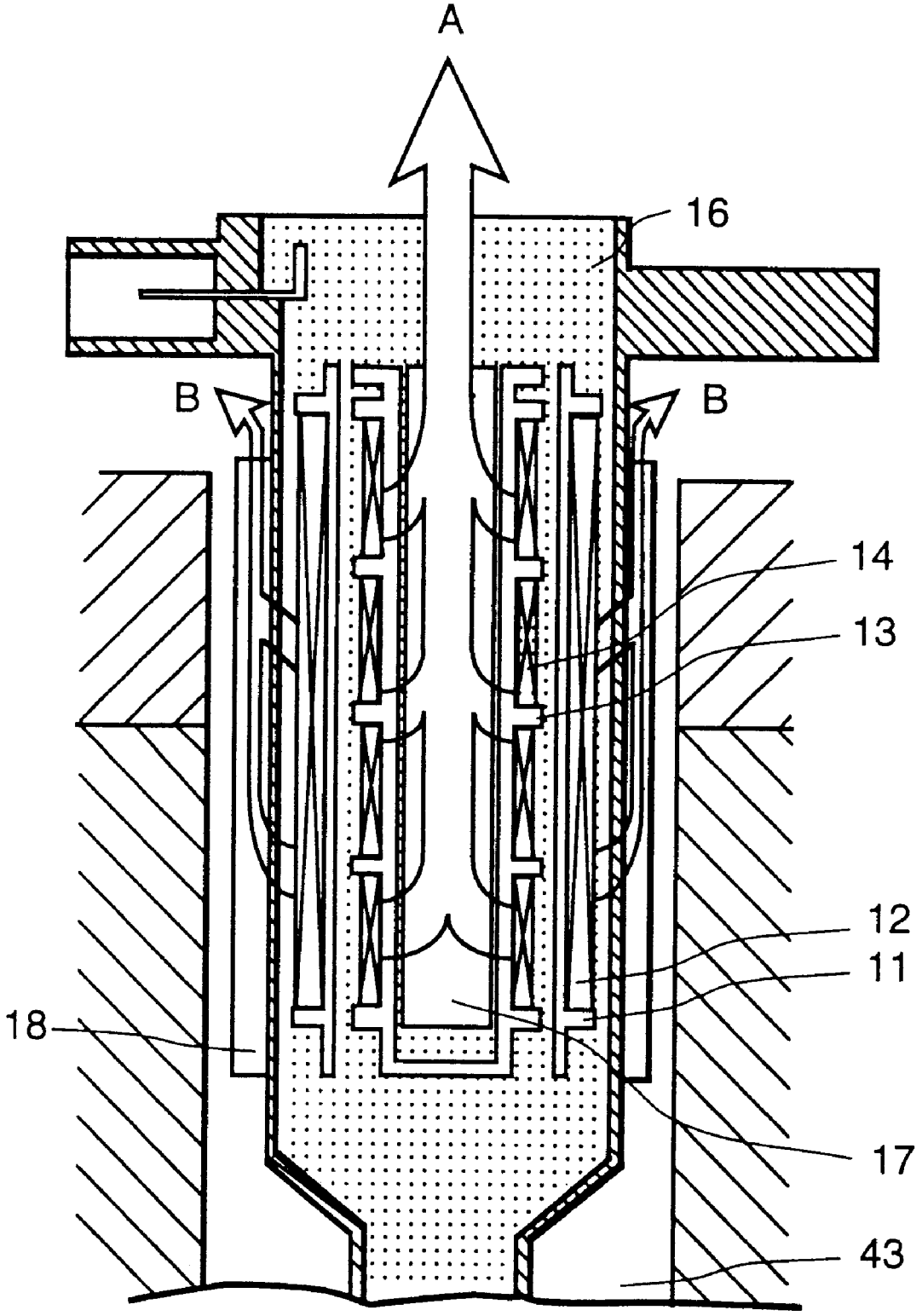
FIG. 12 is an explanatory view showing heat flows generated in an ignition apparatus for use in an internal combustion according to the present invention.

FIG. 12 is an explanatory view showing heat flows generated in an ignition apparatus in an internal combustion according to the present invention.

In the cylindrical form ignition apparatus 10 received in the plug hole 43 (43*a*, 43*b*, 43*c*), a substantial problem is how the heat generation in the primary coil 11 can be made to escape in the air of an outside of the plug hole 43 of the internal combustion engine.

The heat is generated in the primary coil 12 and the secondary coil 14. In general, the heat generation amount of the secondary coil 14 is less than of a half of the heat generation amount of the primary coil 12, and a total sum of an electric power loss in the primary coil 12 and the secondary coil 14 is about less than 4 W.

The above described heat, as shown diagrammatically in FIG. 12, becomes a thermal flow A for escaping to the air from the epoxy resin material 16 through the center core 17 and a thermal flow B for escaping to the air from the epoxy resin material 16 through the side core 18.

With the reasons stated above, when the relationship between the heat (the electric power loss), the temperature rise in the primary coil 12 and the circumferential periphery temperature of the outside of the plug hole are expressed as a thermal resistance, the thermal resistance of the ignition apparatus is about 15° C./W.

When the upper portion of the plug hole is cooled by the air, the thermal resistance of the ignition apparatus 10 is about 5° C./W–10° C./W.

As a result, the ignition apparatus 10 has good conductivity epoxy resin material 16.

The high voltage generated in the secondary coil 14 is supplied to the ignition plug 44 (44*a*, 44*b*, 44*c*) through the high voltage terminal 21, the spring member 22 etc. A portion where the ignition plug 44 is inserted is insulated by the rubber boot 23 such as a silicon rubber member etc.

Figure 13:
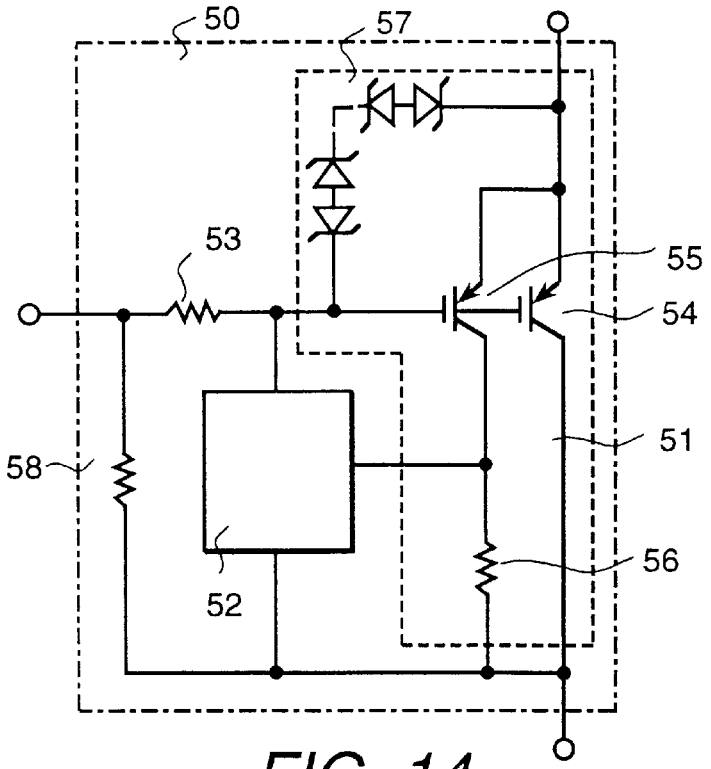
FIG. 13 is a circuit diagram showing an ignitor unit structure of an ignitor case part of an outer case of an ignition apparatus for use in an internal combustion according to the present invention.

An one-chip ignitor 50 installed on the upper portion of the coil portion, as shown in FIG. 13, comprises an insulation type bipolar transistor (hereinafter, "IGBT") 51, a current limitation circuit 52 and an input resistor 53. IGBT 51 comprises a main insulation type bipolar transistor (a main-IGBT 54) and a sub insulation type bipolar transistor (a sub-IGBT 55).

A current detection load 56 is provided between the sub-IGBT 55 and the ground (GND). A dual direction polysilicon zener diode 57 is inserted between a gate and a collector of the IGBT 51, and this diode 57 is configured to have a superior temperature characteristic. Further, this diode 57 clamps the primary voltage with 350–450 V.

A bleeder resistor 58 is inserted between the input and the ground (GND), and a contact current of an input signal connection part is more than 1 mA. A full connection reliability about a soldering of the terminal, even in case the soldering is Sn soldering, can be obtained.

Figure 2:
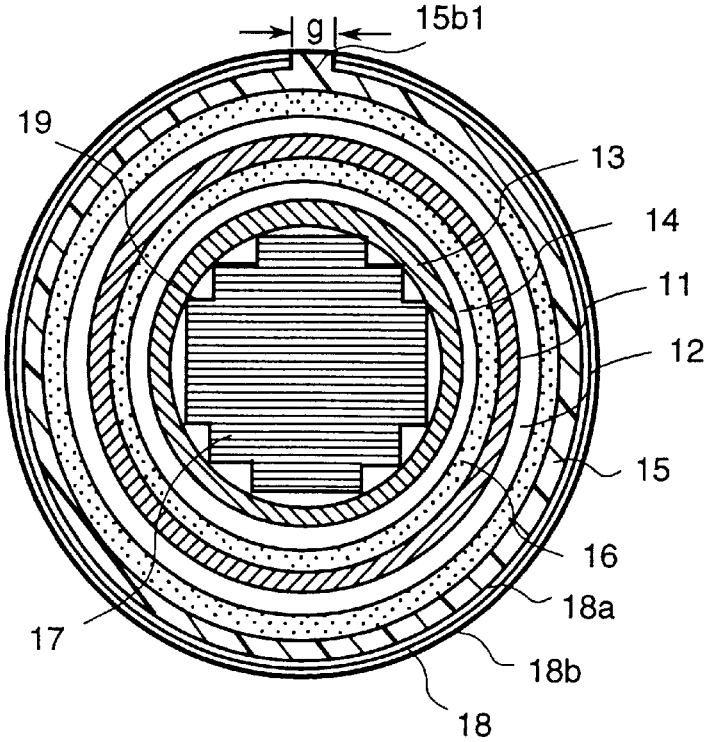
FIG. 2 is a horizontal cross-sectional view showing an ignition apparatus for use in an internal combustion engine.
Figure 3A:
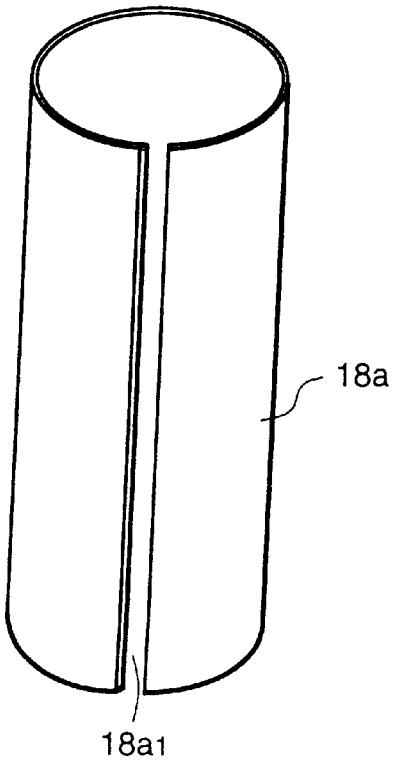
FIG. 3A is a perspective view showing an inner sheet of a side core of an ignition apparatus for use in an internal combustion engine according to the present invention.
Figure 3B:
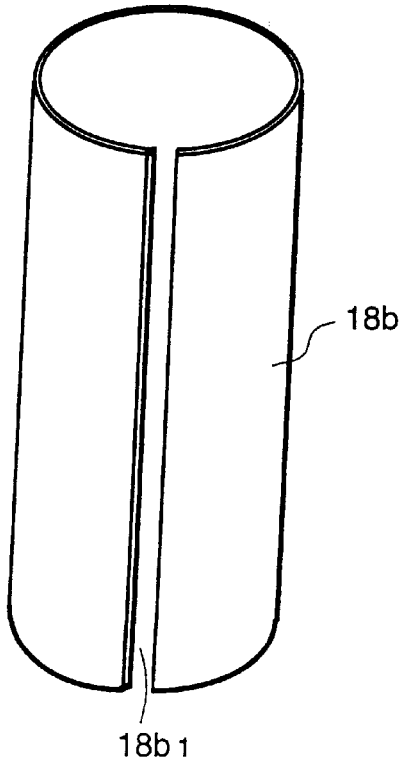
FIG. 3B is a perspective view showing an outer sheet of a side core of an ignition apparatus for use in an internal combustion engine according to the present invention.

In the above stated one-chip ignitor 50, as shown in FIG. 1, copper or an aluminum metal base for a heat radiation is adhered with a silicon adhesion agent at a lower portion of a heat sink of a side where IGBT 51 is joined.

The IGBT 51 and the terminal are connected with an aluminum wire and are molded by an epoxy resin material, and the mold member forms TO-3P type or TO-220 type.

Figure 14:
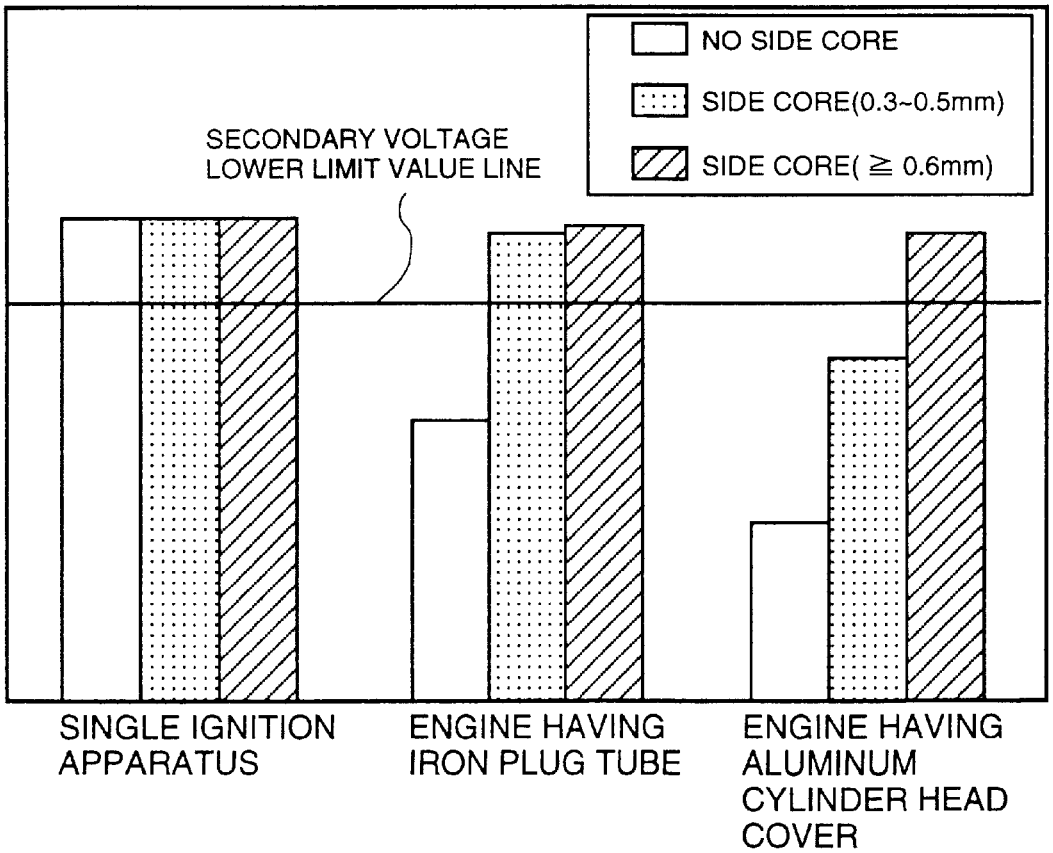
FIG. 14 is a graph showing a secondary voltage comparison of a respective internal combustion engine having a different thickness of a side core of an ignition apparatus for use in an internal combustion according to the present invention.

As understood from FIG. 14, according to this embodiment of the ignition apparatus, even with the internal combustion engine having the iron plug tube and even the internal combustion engine having the aluminum cylinder head cover, the ignition apparatus can achieve the required necessary secondary voltage.

The thickness and the length of the side core can vary in accordance with the material or the length of the cylinder head or the cylinder head cover of the plug hole portion of the internal combustion engine.

Further, the number or the thickness of the magnet which is inserted to one end of the center core or both ends of the center core can vary, and as a result, a low cost ignition apparatus for use in the internal combustion engine can be obtained.

Figure 15:
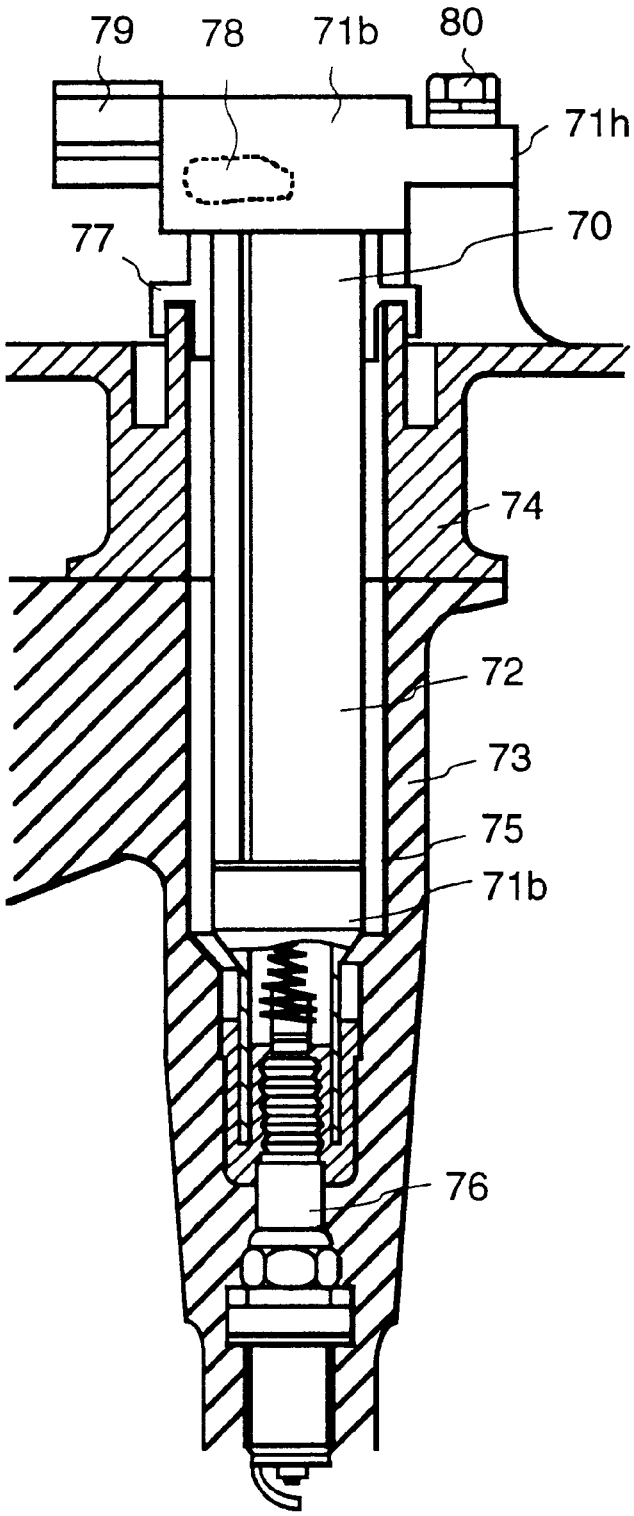
FIG. 15 is a cross-sectional view showing a state where one embodiment of an ignition apparatus for use in an internal combustion engine according to the present invention is mounted on an internal combustion engine.

One embodiment of the cylindrical form ignition apparatus 70 for use in the internal combustion engine according to the present invention, as shown in FIG. 15, is mounted on the internal combustion engine.

Figure 16:
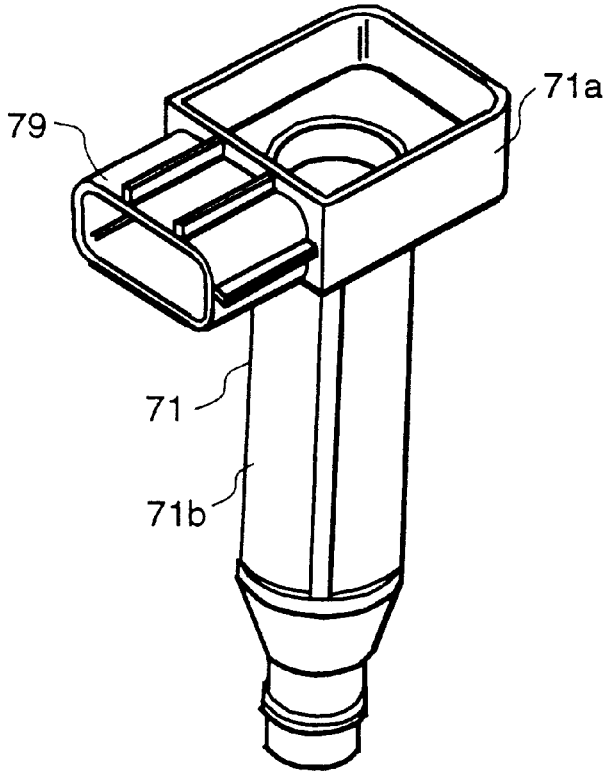
FIG. 16 is a perspective view showing one embodiment of an ignitor case part and a coil case part of an ignition apparatus for use in an internal combustion engine according to the present invention.

As shown in FIG. 16, the ignition apparatus 70 of FIG. 15 has an outer case (a reception portion) 71 and a side core 72.

The outer case 71 comprises an ignitor case part 71*a* (an ignitor reception portion) and a coil case part 71*b* (a coil reception portion).

The internal combustion engine has a cylinder head 73 and a cylinder head cover 74. An ignition plug 76 projects and is fixed toward a combustion chamber of the internal combustion engine.

The ignition apparatus 70 for use in the internal combustion engine is fixed to the cylinder head cover 74 by an installation bolt 80 through an installation portion 71*h* which is provided on the ignitor case part 71*a*. The coil case part 71*b* of the ignition apparatus 70 for use in the internal combustion engine is inserted in a plug hole portion 75.

This plug hole portion 75 is drilled on the cylinder head 73 and the cylinder head cover 74 which easily receive the thermal energy generated in the combustion chamber. As a result, the coil case part 71*b* requires a high heat resistance property of about 710° C.

A hole diameter and a hole depth of the plug hole portion 75 in which the coil case part 71*b* is inserted are standardized at a predetermined rule with a predetermined type of the internal combustion engine.

Next, the ignitor case part 71*a* and the coil case part 71*b* comprising the outer case 71 of this embodiment of the ignition apparatus 70 will be explained referring to FIGS. 16 to 18.

Figure 17:
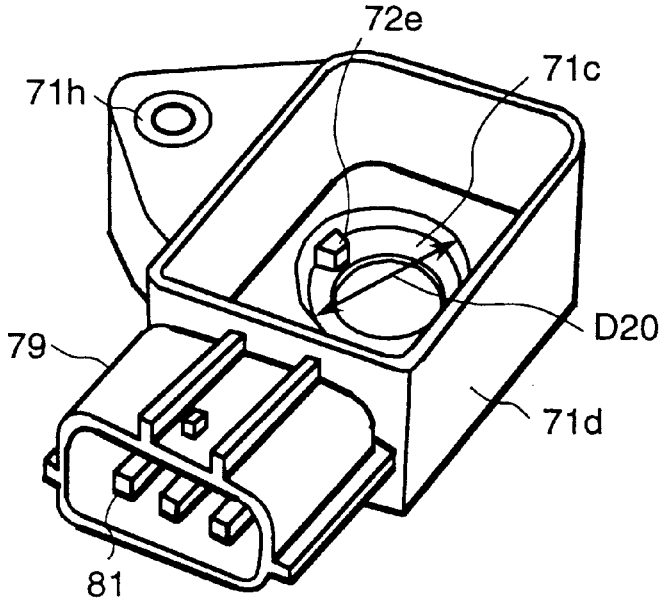
FIG. 17 is a perspective view showing one embodiment of an ignitor case part of an ignition apparatus for use in an internal combustion engine according to the present invention.

In FIG. 17, the ignitor case part 71*a* serves as a connector 79 and is formed by using PBT resin material from aspects of a shock strength and of an assurance of a size dimension accuracy required as the connector 79.

In particular, the connector 79 of the ignitor case part 71*a* has various embodiments to correspond with a different specification of the other connector and the various kinds of the ignitor case part 71*a* manufactured.

Because the connector 79 which fits into the other connector has a complicated form, the connector 79 is manufactured using a slide molding processing. Accordingly, to manufacture the ignitor case part 71*a* with the connector 79, the ignitor case part 71*a* requires a material with an excellent molding property.

As stated above, it was difficult in the prior art to standardize the ignitor case part 71*a*, which has the connector 79 for corresponding the different specification of the other connector, where the outer case 71 has been integrally formed.

Figure 18:
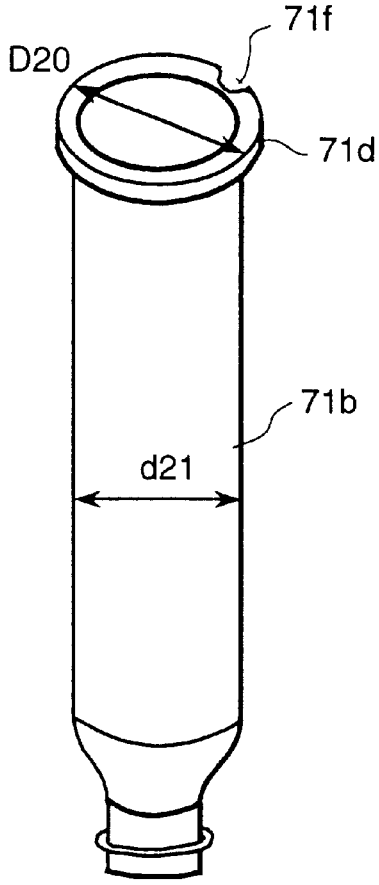
FIG. 18 is a perspective view showing one embodiment of a coil case part of an ignition apparatus for use in an internal combustion engine according to the present invention.

Therefore, as shown in FIG. 16, FIG. 17 and FIG. 18, the outer case part 71*b* comprises the independent and individual ignitor case part 71*a* and the independent and individual coil case part 71*b*. Further, the ignitor case part 71*a* has a combination portion (namely, a fitting-into portion) with the coil case 71*b* to integrally form the ignitor case part 71*a* and the coil case part 71*b*.

A step portion 71*c* for preventing a slip off and a projection portion 71*e* for preventing a rotation stop and for determining a position are provided on the above referenced combination portion. Further, a portion for receiving an ignitor case 78 etc. as the ignitor case part 71*a* forms a cup (inside box) form.

As shown in FIG. 18, the coil case part 71*b* is inserted in the standardized plug hole portion 75. The coil case part 71*b* is formed using PPS resin material because of its heat resistance property, etc.

The coil case part 71*b* can be a mixture resin material in which a denatured polyphenylene oxide resin material ("denatured PPO" or "denatured PPO resin material") being as a composition agent, for example 20%, is blended to PPS resin material.

As a result, the combination portion (namely, the fitting-into portion) is provided on the ignitor case part 71*a* to integrate the coil case part 71*b*. A step portion 71*e* for preventing a slip off and a notch portion 71*f* for preventing a rotation stop and for determining a position are provided on the combination portion.

Herein, to utilize the standardization of the plug hole portion 75, in response to the size dimension of the regulated plug hole portion 75, an appearance size dimension of the coil case part 71*b* (for example, diameter D20 of the step portion 71*d*, a diameter d21 and an entire length of the ignition apparatus case main body) can be made uniform. Accordingly, a common use of the coil case part 71*b* can be attained.

Further, the diameter D20 of the step portion 71*d* is the same size dimension of the dimension D20 of the step portion 71*c* as shown in FIG. 17. In particular, the diameter D20 of the step portion 71*c* is the same diameter of the ignitor case part 71*a* which is manufactured by a different form to correspond with the other connector having a different specification. The diameter D20 of the step portion 71*c* is unified to utilize the standardization of the plug hole 75.

Figure 19:
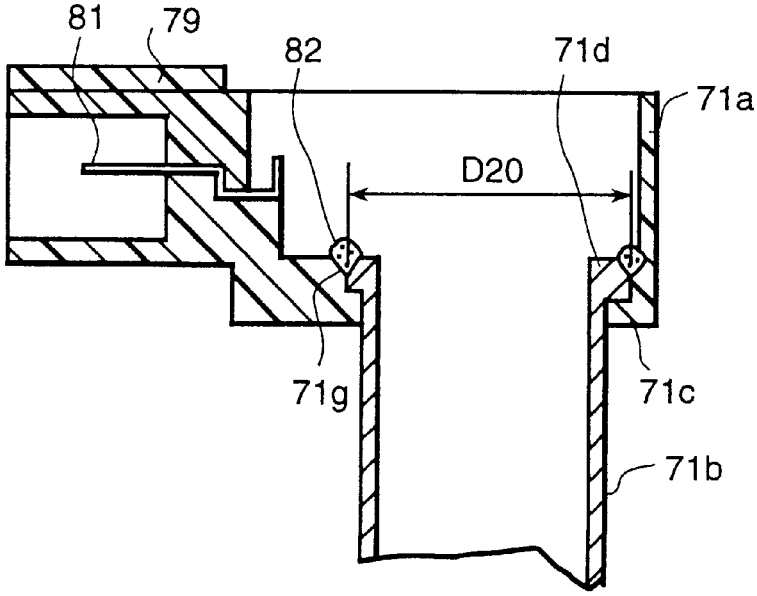
FIG. 19 is a cross-sectional, fragmentary view showing where a coil case part and an ignitor case part of one embodiment of an ignition apparatus for use in an internal combustion engine according to the present invention are integrally combined at a combination portion of the coil case part and the ignitor case part.

FIG. 19 is a cross-sectional view showing a state where at the combination portion of the coil case part and the ignitor case part, one embodiment of both the coil case part and the ignitor case part are integrally combined at the combination portion according to the present invention.

The outer case 71 comprised of the ignitor case part 71*a* and the coil case part 71*b* has two parts to correspond to the difference in the environment condition for mounting and the various kinds of the connector specification required.

However, finally to use the ignition apparatus 70 for use in the internal combustion engine, the ignitor case part 71*a* and the coil case part 71*b* should be integrally combined at the fitting-into portion.

Therefore, at the combination portion, namely at the step portion 71*c* of the ignitor case part 71*a* and at the step portion 71*d* of the coil case part 71*b*, the ignitor case part 71*a* and the coil case part 71*b* are combined at the fitting-into portion.

In other words, at the combination portion (namely, the fitting-into portion) corresponding to a portion which corresponds to a vicinity of an upper face of the plug hole portion 75 for receiving or inserting the ignitor case part 71*a* and the coil case part 71*b* to the internal combustion engine, the ignitor case part 71*a* and the coil case part 71*b* are fitted into and integrally combined at the combination portion.

More concretely, in the embodiment shown in FIG. 19, an adhesive agent 82 is coated in a V form groove 71*g* which is provided on the combination portion. The combination portion is combined or joined using the adhesion processing. Here, the projection portion 71*e* and the notch portion 71*f* are meshed and then the rotation direction is fixed.

As stated above, the outer case 71 according to the embodiment of the ignition apparatus comprises the independent and individual ignitor case part 71*a* and the independent and individual coil case part 71*b*. The ignitor case part 71*a* has various forms to correspond to the other connector having different specifications.

The coil case part 71*b* has a standardized outer appearance (the diameter and the entire length) which corresponds to the standardized plug hole portion 75. The ignitor case part 71*a* and the coil case part 71*b* are integrally combined at the combination portion.

Further, in the combination face (namely, the fitting-into face) of both step portions 71*c* and 71*d*, the rectangular angle between the axial direction of the coil case part 71*b* (namely, the hole axial direction of the plug hole portion 75) and the connection direction of the connector 79 (a right angle against the hole axial direction of the plug hole portion 75) and also the size dimension accuracy of a distance between an axial center of the coil case part 71*b* and a center of an installation portion 71*h* secures the ignitor case part 71*a*.

In other words, the combination face of both step portions 71*c*, 71*d* is formed to have a contact face which is vertical with the axial direction of a longitudinal direction of the coil case part 71*b* (namely, the hole axial direction of the plug hole portion 75) and a contact face which is concentric with an axial center of the coil case part 71*b*. Accordingly, in the combination portion, both step portions 71*c*, 71*d* are fitted together and strongly joined with no aberration.

TABLE 1

| Material Characteristic | PPS | PBT | Denatured PPO | PPS + denatured PPO | Connector Requirement | Coil Case Requirement |
|---|---|---|---|---|---|---|
| heat resistance | ◎ | ○ | Δ | ◎ | | ◎ |
| shock strength | Δ | ◎ | ○ | Δ | ◎ | |
| chemical proof | ◎ | ◎ | Δ | ○ | ◎ | ○ |
| adhesion | Δ | ○ | ◎ | ◎ | | ○ |
| voltage withstand | ◎ | ○ | ○ | ○ | | ◎ |

Table 1 is a table which is put in the order of material for use in the coil case part 71*b* and material for use in the ignitor case part 71*a* with the connector 79 by estimating the requirement characteristic of the coil case part 71*b* and the ignitor case part 71*a*.

In Table 1, with respect to the materials for use in the coil case part 71*b* and the connector 79, every characteristic item required from each use, an order of a superior material characteristic and an order of a requirement degree are respectively expressed by ◎, ○, Δ and the results are shown.

Namely, the required characteristics of the coil case part 71*b* which is inserted in the plug hole portion 75 for receiving the coil unit are mainly the heat resistance characteristic and the voltage withstanding characteristic.

The required characteristics of the ignitor case part 71*a* which receives the ignitor unit 78 and has an important function as the connector 79 are mainly the shock strength and the chemical-proof characteristic.

As stated above, each of the materials of the ignitor case part 71*a* and the coil case part 71*b* being the outer case 71 has a different required characteristic.

Accordingly, it is desirable to constitute the two-part divided structure and the integral combination structure for the coil case part 71*b* and the connector 79 (namely, the ignitor case part 17*a*), and the above consideration will be understood from Table 1.

The material for satisfying the required characteristics of the connector 79 is PBT resin material, for example. On the other hand, the material for satisfying the required characteristic of the coil case part 71*b* is PPS resin material or a mixture resin material of PPS and the denatured PPO, for example.

Herein, in using PPS resin material, it is necessary to consider the adhesion property (or the stick property). Namely, because the adhesion property between the insulation epoxy resin material for filling up and enclosing and the coil case part 71*b* is inferior, peel-off may occur, and this causes a defect. Further, there is a possibility of ignition failure.

Accordingly, to ensure the long period insulation property of the ignition apparatus 70, it is necessary to maintain the adhesion of the epoxy resin material and the coil case part 71*b*.

More specifically, the thermal stress under −40° C. and 130° C., which is the equivalent of the temperature environment condition of the internal combustion engine, alternatively and repeatedly adds up, and it is desirable to not generate the peel-off at more than 300 cycles.

Where, as the material of the coil case part 71*b*, PPS resin material is used alone, it has been ascertained that the generation of the peel-off can occur in less than 300 cycles according to the use condition.

On the other hand, denatured PPO has a good adhesion property against the insulation epoxy resin material. In general, denatured PPO is used as the material of a secondary coil of the ignition apparatus. However, since the denatured PPO is inferior in its chemical-proof property, the denatured PPO is not suitable for a portion where the substance is exposed to the outside atmosphere.

Herein, a sealing rubber body 77 is inserted in the vicinity of the upper face of the plug hole portion 75 of the internal combustion engine to isolate the environment inside and outside of the plug hole portion 75.

In addition to the prevention of water intrusion, the sealing rubber body 77 performs an important role in that it does not expose the coil case part 71*b* to the outside atmosphere. Accordingly, denatured PPO can be used as the coil case part 71*b*.

The material for the coil case part 71*b* can correspond to the following mixture material. The mixture material comprises PPS resin material having a superior heat resistance property, a superior chemical-proof property and a superior voltage withstanding property, and denatured PPO having a superior adhesion property to the insulation epoxy resin material.

For example, PPS resin material is the base material and 20% degree denatured PPO is mixed with the PPS resin material. Therefore, the coil case part 71*b* is uses the mixture material having the respective characteristics of PPS resin material and denatured PPO.

Namely, as the material for the coil case part 71*b*, it is desirable to mix the base material having the material characteristics of the superior heat resistance property and the superior voltage withstanding property and the mixture agent having the material characteristic of the superior adhesion property to the insulation resin material for insulating the coil part. Further, it is desirable to form the mixture material for utilizing the material characteristic which has the respective resin material.

In other words, the function of the sealing rubber body 77 can be utilized effectively for isolating the environment of the inside and the outside of the plug hole portion 75.

Namely, the ignition apparatus 70 for use in the internal combustion engine comprises an ignitor part having an electrically connected and adjacently arranged connector 79, and the coil case part 71*b*, and the reception body 71 (71*a* and 71*b*) for receiving the ignitor part and the coil part.

The reception body 71 has two parts comprised of a coil reception portion 71*b* and an ignitor reception portion 71*a*. The coil reception portion 71*b* receives the coil part and is inserted into a standardized plug hole portion 75 of the internal combustion engine.

The ignitor reception portion 71*a* receives the ignitor part and is arranged outside of the plug hole and has the connector 79 which is connected to the other connector having a different specification. The coil reception portion 71*b* and the ignitor reception portion 71*a* are integrally combined at the combination portion.

Besides, where an allowable range exists in the required environment specification, it is possible to use the same material for the coil case part 71*b* and the ignitor case part 71*a*.

In this instance, because each of the coil case part 71*b* and the ignitor case part 71*a* is formed separately, the molding conditions, such as a mold parting line direction, an injection gate position and a push-out pin position of the mold form which suits the respective form, can be set appropriately.

Accordingly, defects caused by molding can be reduced and a superior case having the above stated rectangular angle and size dimension accuracy results. The use range can be enlarged according to the above stated advantages.

With respect to this embodiment, it is desirable to employ PPS resin material which is well-balanced in its heat resistance property, chemical-proof property and the voltage withstanding property in comparison with other resin materials.

To sum up the above, the essential feature of the present invention is that the reception body 71 being as the outer body comprises two parts comprised of the coil case part 71*b* and the ignitor case part 71*a*.

The coil case part 71*b* serves as the coil reception portion, the coil case part 71*b* receives mainly the coil part and is inserted into the plug hole portion 75 in which a hole diameter is standardized for the internal combustion engine.

The ignitor case part 71*a* serves as the ignitor reception portion and receives mainly the ignitor part, and has the connector 79 which is connected to the other connector having a different specification. The coil case part 71*b* and the ignitor case part 71*a* are integrally combined at the combination portion.

In other words, the reception body 71 comprises two parts comprised of the coil reception portion 71*b* inserted in the plug hole portion 75 and the ignitor reception portion 71*a* positioned outside of the plug hole portion 75 by making the boundary of the inside portion and the outside portion of the plug hole 75 of the internal combustion engine in which the environment required specification differs. The environment required specification is determined by the environment where the reception body 71 is arranged.

The coil reception portion 71*b* and the ignitor reception portion 71*a* comprise the parts and are integrally combined at the combination portion.

Further, the coil case part 71*b* for receiving the ignition apparatus main body and the ignitor case part 71*a* for serving as the connector 79 and for receiving the ignitor unit 78 are separate.

Then the coil case part 71*b* is made by using the synthetic resin material having superior heat resistance property, superior voltage withstanding property and superior adhesion property with the coil insulation resin material.

Figure 20:
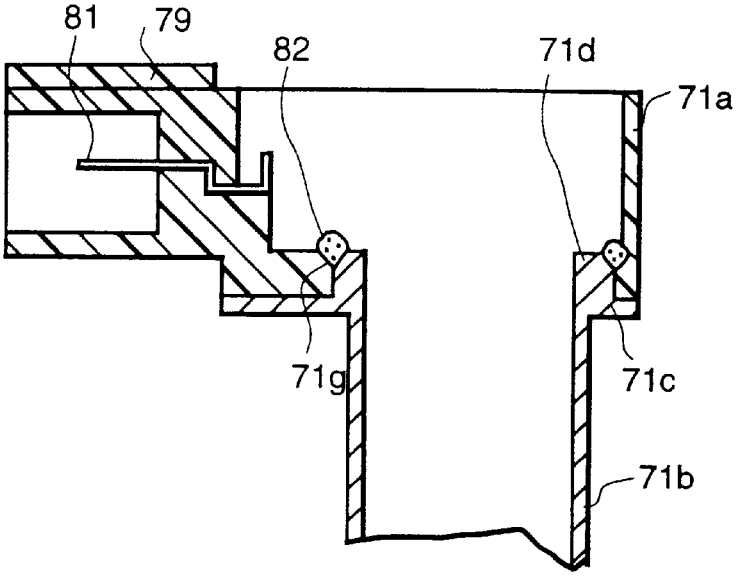
FIG. 20 is a cross-sectional, fragmentary view showing where a coil case part and an ignitor case part of another embodiment of an ignition apparatus for use in an internal combustion engine according to the present invention are integrally combined at a combination portion of the coil case part and the ignitor case part.

As shown in FIG. 20, the coil case part 71*b* has an extension portion (a development portion) in which the step portion 71*d* of the coil case part 71*b* extends toward a bottom portion of the ignitor case part 71*a*.

Because the development portion exists, the above stated rectangular angle and the size dimension accuracy are improved. Further, because of the enlarged contact face, stability of the fitting-into at the combination portion is achieved.

The development portion of the coil case part 71*b* having the superior heat resistance property covers the ignitor case part 71*a*, and the heat resistance property of the bottom portion of the ignitor case part 71*a* which arranges oppositely to the cylinder head cover 74, etc. of the internal combustion engine is improved.

Namely, even the use of the ignitor case part 71*a* made of the synthetic resin material having a somewhat inferior heat resistance property has advantages for corresponding severe environment conditions wherein the part facing to the cylinder head cover 74, etc. of the internal combustion engine which is provided outside of the plug hole portion 75 reaches a maximum temperature of 130° C.

The joining between the coil case part 71*b* and the ignitor case part 71*a* can be carried out by a joining method using adhesion agent 82, a method for injecting and for fixing by using a fill-up insulation epoxy resin material, a method for manufacturing separately in advance the coil case part 71*b* and the ignitor case part 71*a* and after that for integrally molding and for fixing them, etc. Any suitable method can be employed.

Figure 21:
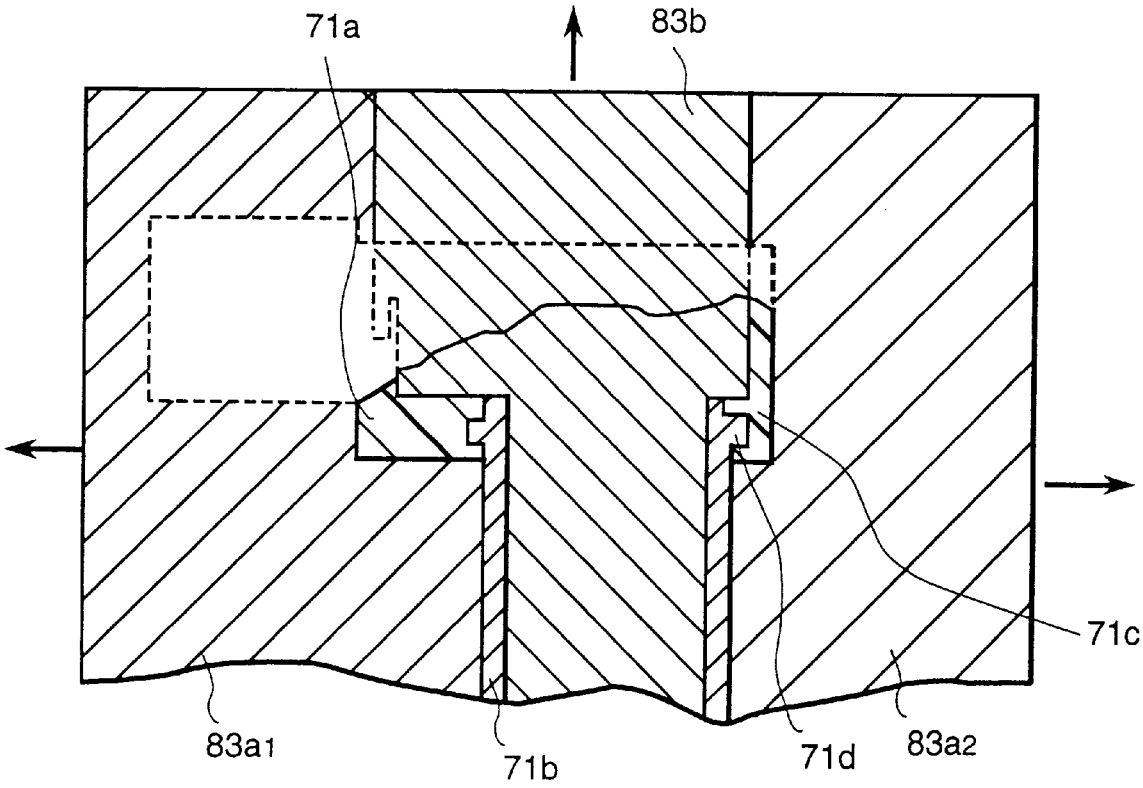
FIG. 21 is a cross-sectional, partial view showing where a coil case part and an ignitor case part of a further embodiment of an ignition apparatus for use in an internal combustion engine according to the present invention are integrally combined at a combination portion of the coil case part and the ignitor case part.

FIG. 21 is a cross-sectional view showing a further embodiment of a state where a coil case part and an ignitor case are integrally combined at a combination portion of the coil case part and the ignitor case part according to the present invention.

Namely, this figure shows a view of a cross-section of the molding state of both cases according to the method for integrally molding and for fixing as stated above.

In FIG. 21, the cross-section has a left sliding metal mold 83*a*1 and a right sliding metal mold 83*a*2 for molding a metal mold and a core mold 83*b*, and an arrow shows a movable sliding direction of the respective mold.

In integral molding, one of the step portion 71*c* and the step portion 71*d* is buried against the other side case for integrally molding. As a result, the buried step portion serves the role of the pull-out prevention or the rotation stop prevention, and with one tome process of the mold processing, the combination (join) and the pull-out prevention or the rotation stop prevention is carried out effectively.

As stated above, the coil case part 71*b* and the ignitor case part 71*a* for receiving the ignitor unit 78, etc. and serving as the connector 79 are separately formed. As a result, the cylindrical form ignition apparatus 70 for use in the internal combustion engine for satisfying the respective required characteristic for the connector 79 and the coil case part 71*b* can be obtained.

Further, the ignitor case part 71*a* forms an arrangement where the connector 79 extends toward in a lateral direction of the ignitor unit 78, namely the connector 79 extends toward the rectangular direction with the hole axial direction of the plug hole portion 75 of the internal combustion engine.

Accordingly, the entire length in the vertical direction of the ignition apparatus 70 for use in the internal combustion engine is shortened and a space utilization is improved.

Further, in general, the ignition apparatus 70 is connected to a control apparatus having the other part connector with a different specification. The other connector has a different connector direction and also a different installation position, and this connector has a different form for corresponding to the respective internal combustion engine.

According to the present invention, the above stated correspondence can be performed in accordance with the size dimension alternation of only the side of the ignitor case part 71*a*. As a result, the common use of the ignitor case part 71*a* and the coil case part 71*b* can be attained, and the standardization in the components can be realized, and the low cost ignition apparatus for use in the internal combustion engine is achieved.

According to the present invention, in response to the required specification (the characteristic), the respective most suitable size dimension and the respective most suitable material can be selected, as a result the strength and the size dimension of the connector 79, and the durability of the coil part of the ignition apparatus 70 for use in the internal combustion engine can be improved.

Further, in the manufacture of the ignition apparatus 70 for use in the internal combustion having a different specification, it can correspond according to the alternate of only the ignitor case part 71*a*, and the common use of the ignitor case part 71*a* with the coil case part 71*b* can be attained.

Accordingly, for example, in case of the cylindrical form ignition apparatus 70, the high durability and the high reliability ignition apparatus 70 for use in the internal combustion engine having the short overall length, a high dimensional accuracy and high strength of the connector 79, a superior heat resistance shock property and superior voltage withstanding property are achieved.

Next, a sealing rubber member structure or body and a sealing structure having a sealing rubber member of an ignition apparatus for use in an internal combustion engine according to the present invention will be explained.

A construction and an operation of one embodiment of a sealing rubber member structure and a sealing structure will now be explained referring to FIG. 22 and FIG. 23.

Figure 23:
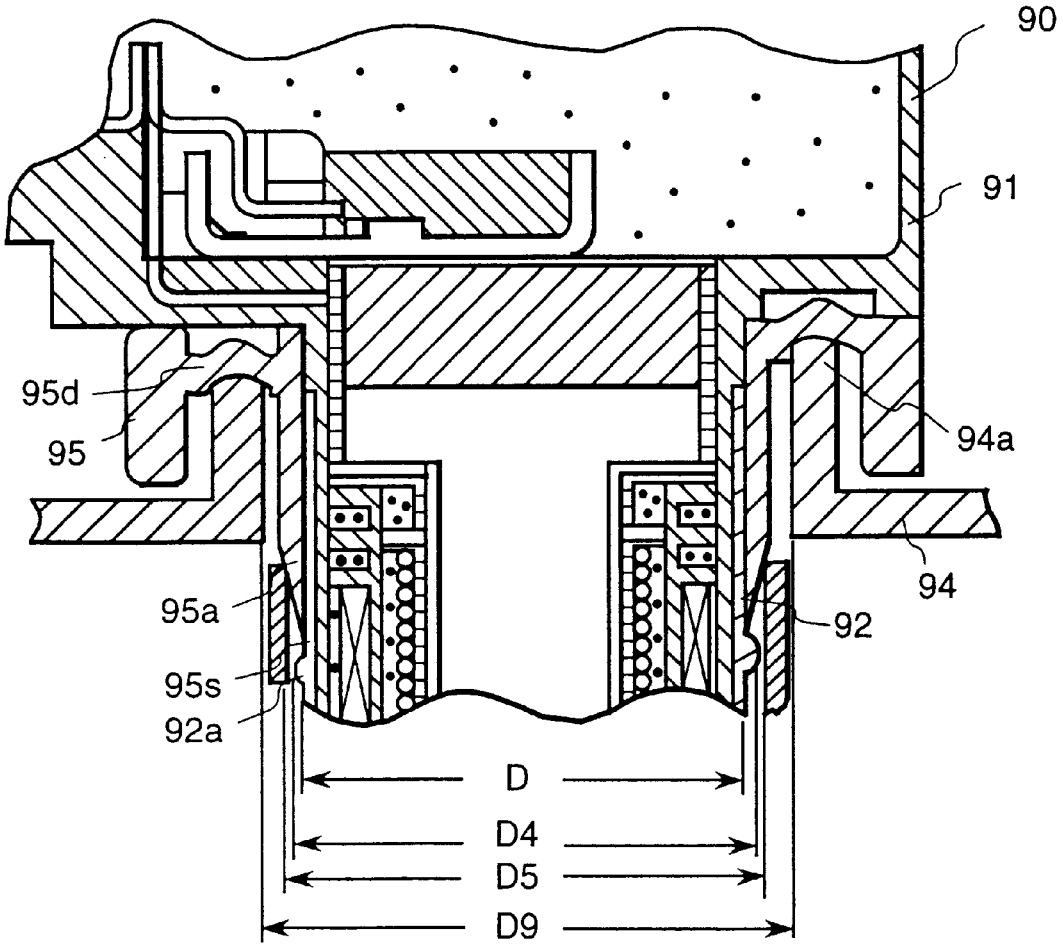
FIG. 23 is a cross-sectional view showing a sealing structure using a sealing rubber member of an ignition apparatus for use in an internal combustion according to the present invention.

As shown in FIG. 23, one embodiment of an ignition apparatus 90 comprises a coil case part 91, a side core 92 having several hemisphere form projection portions 92*a*, and a sealing rubber member 95. The internal combustion engine has a plug tube 93 and a cylinder head cover 94.

In FIG. 23, D is an outer diameter of an inner cylindrical portion of the ignition apparatus 90, D9 is an inner diameter of the cylinder head cover 94, D5 is 25 an inner diameter of the plug tube 93, and D4 is an outer diameter of the projection portion 92*a* of the side core 92.

As shown in FIG. 23, the sealing rubber member 95 comprises a conical portion 95*a* having an inner diameter D1, a step portion 95*b*, an inside cylindrical portion 95*c* having an inner diameter D2 and an outer diameter D3, a flange portion 95*d* for forming a radial direction extending face, an upper end portion 95*e*, a dent or connecting portion 95*f*, and an outside cylindrical portion 95*g*. The step portion 95*b* is dimensioned such that D1<D<D2 and the dent portion 95*f* is provided on the flange portion 95*d*.

The sealing rubber member 95 with the above stated structure is inserted under pressure and fixed to the inner cylindrical portion of the ignition apparatus 90.

Because the sealing rubber member 95 has the step portion 95*b* sized to have D1<D<D2, a pressure-in dimensional tolerance at a side of the conical portion 95*a* can be made larger.

In other words, in the inside cylindrical portion 95*c* having the inner diameter D2 of the sealing rubber member 95, the inner diameter D2 of the inside cylindrical portion 95*c* is larger than the outer diameter D of the inner cylindrical portion of the ignition apparatus 90. Therefore, the sealing rubber member 95 can easily be inserted into the inner cylindrical portion of the ignition apparatus 90.

On the other hand, in the conical portion 95*a* having the inner diameter D1 of the sealing rubber member 95, a thickness of the conical portion 95*a* for inserting under pressure can be secured fully.

Further, since the pressure-in dimensional tolerance at the conical portion 95*a* of the sealing rubber member 95 is made larger, a pressure-in force can also made large, where the ignition apparatus 90 is received at the plug tube 93 in the plug hole portion, so that a turn up of the conical portion 95*a* of the sealing rubber member 95 can be prevented.

Where the ignition apparatus 90 is received at the plug tube 93 in the plug hole portion, a tapering face of the conical portion 95*a* of the sealing rubber member 95 serves the role of a guide member.

Namely, where the sealing rubber member 95 is inserted into the inner cylindrical portion of the ignition apparatus 90, the sealing rubber member 95 has the conical portion 95*a* and a conical tip end portion 95*s* of the conical portion 95*a*. The conical portion 95*a* having the conical tip end portion 95*s* has a tapering form where the outer diameter reduces gradually toward a tip end at the side of an ignition plug.

Further, an outer peripheral face of the outer diameter D3 of the inside cylindrical portion 95*c* of the sealing rubber member 95 forms a non-contacting state (D3<D9) with respect to an inner peripheral face of the inner diameter D9 of the plug hole portion in the cylinder head cover 94. As a result the sealing rubber member 95 can be inserted easily to the plug hole.

The projection portion 92*a* of the side core 92 forming the inner cylindrical portion has a projection shape which projects toward a part or the entire outer periphery of the cylindrical portion of the ignition apparatus 90.

The tip end portion 95*s* of the conical portion 95*a* of the sealing rubber member 95 becomes the tip end of the side of the ignition plug of the sealing rubber member 95 which has been inserted into the inner cylindrical portion of the ignition apparatus 90. The projection portion 92*a* of the side core 92 positions at a side of the ignition plug closer than the conical tip end portion 95*s* of the conical portion 95*a* of the sealing rubber member 95.

The outer diameter D4 of the projection portion 92*a* of the side core 92 has a size relationship of D<D4<D5. An outer diameter of the conical tip end portion 95*s* of the inserted sealing rubber member 95 forms smaller than the outer diameter D4 of the projection portion 92*a* of the side core 92. Therefore, the turn up of the sealing rubber member 95 can be prevented.

Namely, where the sealing rubber member 95 is inserted into the inner cylindrical portion of the ignition apparatus 90, the conical tip end portion 95*s* of the sealing rubber member 95 is positioned at a rear portion of the projection portion 92*a* of the side core 92.

Therefore, when the ignition apparatus 90 is inserted into the plug hole portion and the plug tube 93, the turn up of the sealing rubber member 95 can be prevented. The projection portion 92*a*, which serves as the inner cylindrical portion of the side core 92 can be provided on the coil case part 91.

Figure 22:
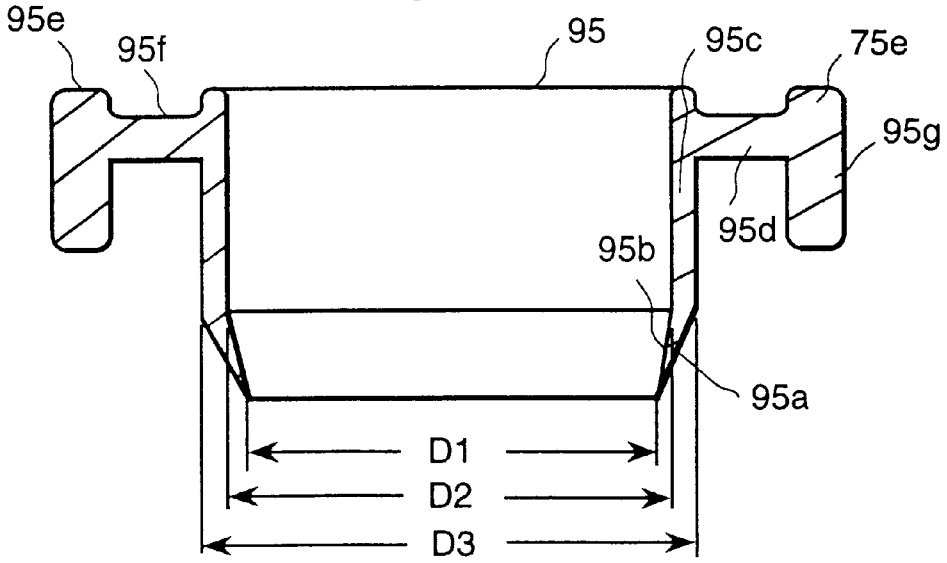
FIG. 22 is a cross-sectional view showing a sealing rubber member of an ignition apparatus for use in an internal combustion according to the present invention.

In the sealing rubber member 95 of this embodiment of the ignition apparatus 90 according to the present invention, as shown in FIG. 22, when the ignition apparatus 90 is inserted into the plug hole portion, the flange portion 95*d* for forming the radial direction extending face of the sealing rubber member 95 contacts a tip end portion 94*a* of the cylinder head cover 94.

With the above condition, the sealing structure having the sealing rubber member 95 of the ignition apparatus 90 can be formed. As a result, water penetration into the cylinder head cover 94 be prevented.

Namely, as stated in above, in the tip end portion 94*a* in the plug hole portion, a dimensional scatter size of about 1 mm degree occurs in the axial direction.

However, when the flange portion 95*d* of the sealing rubber member 95 contacts the tip end portion 94*a* of the cylinder head cover 94 and is pushed under pressure, the flange portion 95*d* of the sealing rubber member 95 deforms to prevent water penetration, etc.

The extension face formed on the flange portion 95*d* and extending toward the radial direction constitutes a face for extending and expanding toward the radial direction of the inner cylindrical portion of the ignition apparatus 90.

Even if the tip end portion 94*a* of the cylinder head cover 94 slips off about 1 mm degree toward the radial direction, the extension face always contacts the slipped-off tip end portion 94*a* of the cylinder head cover 94. Therefore, an excellent sealing property of the ignition apparatus 90 can be assuredly obtained.

A necessary extent of the extension face of the flange portion 95*d* of the sealing rubber member 95 is one where the position slip-off of the plug hole can be fully absorbed, in other words, where the slip-off toward the radial direction of the tip end portion 94*a* (the outside cylindrical end portion) of the cylinder head cover 94 can escape.

For example, the extent is more than one which has a total dimension size of an end portion dimension size of the tip end portion 94*a* of the cylinder head cover 94 in addition to the maximum slip-off dimension size.

On the other hand, the tapering form conical portion 95*a* of the sealing rubber member 95 serves as a guide member where the inner cylindrical portion of the ignition apparatus 90 is inserted into the plug hole portion and the plug tube 93. Therefore, an alignment between the cylindrical portion of the ignition apparatus 90 and the plug tube 93 occurs with assurance.

Accordingly, the maximum slip-off dimension size must be absorbed between the plug hole portion formed by the cylinder head cover 94 and the sealing rubber member 95. Therefore, the extension face of the sealing rubber member 95 can absorb the positional slip-off and further can provide the sealing function.

The above sealing structure of the ignition apparatus according to the present invention is exemplified with the ignition apparatus where the internal combustion engine has the plug tube in addition to the cylinder head and the cylinder head cover of the internal combustion engine.

However, the above stated sealing structure according to the present invention can be employed with the ignition apparatus where the internal combustion engine has the cylinder head and the cylinder head cover but has no plug tube.

We claim:

1. An ignition apparatus for use in an internal combustion engine, comprising a center core;

a primary coil on a primary bobbin;

a secondary coil on a secondary bobbin and arranged an inner side of said primary coil;

an outer case provided with a projection; and a side core arranged on an outer periphery of said outer case and having a notch engageable with the projection;

said primary coil and said secondary coil arranged between said center core and said outer case, whereby the ignition apparatus is configured to be received in a plug hole which is formed by a cylinder head and a cylinder head cover of the internal combustion engine; wherein said side core comprises at least one silicon steel sheet and has a slit between two side wall ends extending in a horizontal direction of said side core, and said slit is arranged to prevent a one-turn short of a magnetic flux of said side core and to obtain a predetermined secondary voltage in excess of an engine required secondary voltage.

2. An ignition apparatus for use in an internal combustion engine according to claim 1, wherein said side core comprises a material selected from one of a single grain oriented silicon steel sheet having a slit between two side wall ends extending to a horizontal direction of said side core and a single grain non-oriented silicon steel sheet having a slit between two side wall ends extending to the horizontal direction of said side core.

3. An ignition apparatus for use in an internal combustion engine according to claim 1, wherein said side core comprises a laminated sheet structure having at least two grain oriented silicon steel sheets, each of said at least two grain oriented silicon steel sheets has a slit between two side wall ends extending to the horizontal direction of said side core, and each of said plural slits is arranged to be aligned at substantially the same position.

4. An ignition apparatus for use in an internal combustion engine according to claim 1, wherein said side core comprises a material selected from one of a laminated sheet structure having one grain non-oriented silicon steel sheet with a slit between two side wall ends extending to the horizontal direction of said side core and at least one grain oriented silicon steel sheet having a slit between two side wall ends extending to the horizontal direction of said side core, and said slit of said one grain non-oriented silicon steel sheet and each of said slits of said at least one grain oriented silicon steel sheet are arranged to be aligned at substantially the same position.

5. An ignition apparatus for use in an internal combustion engine according to claim 1, wherein a magnet for generating an opposite side direction magnetic flux against a magnetic flux formed by said primary coil is provided on one end of said center core or on both ends of said center core.

6. An ignition apparatus for use in an internal combustion engine comprising a center core;

a primary coil on a primary bobbin;

a secondary coil on a secondary bobbin and arranged an inner side of said primary coil;

an outer case; and a side core arranged on an outer periphery of said outer case;

said primary coil and said secondary coil arranged between said center core and said outer case, whereby the ignition apparatus is configured to be received in a plug hole which is formed by a cylinder head and a cylinder head cover of the internal combustion engine; wherein said side core comprises at least one silicon steel sheet and has a slit between two side wall ends extending to a horizontal direction of said side core, and said slit is arranged to prevent a one-turn short of a magnetic flux of said side core and to obtain a predetermined secondary voltage in excess of an engine required secondary voltage, wherein said cylinder head and said cylinder head cover in which said ignition apparatus is configured to be used are of an aluminum material, and said side core is formed in a substantially pipe-like form and laminated with at least two sheets of a grain oriented silicon steel sheet, each having a thickness of 0.3–0.5 mm, said side core having a total sheet thickness of more than 0.6 mm, and each sheet having a slit between two horizontally extending side wall ends and said plural slits arranged to be aligned at substantially the same position.

7. An ignition apparatus for use in an internal combustion engine according to claim 6, wherein an upper end of said side core is positioned substantial at an upper end of said cylinder head cover or said upper end of said side core is positioned lower than an upper end of said center core.

8. An ignition apparatus for use in an internal combustion engine according to claim 6, wherein an iron made plug tube is configured to be inserted under pressure in said plug hole of the internal combustion engine, and said side core is formed in a substantially pipe-like form and laminated with one of a single grain non-oriented steel sheet having a slit between two horizontally extending side wall ends and having a sheet thickness of 0.3–0.5 mm and a single grain oriented steel sheet having a slit between two horizontally extending side wall ends and having a sheet thickness of 0.3–0.5 mm.

9. An ignition apparatus for use in an internal combustion engine according to claim 8, wherein an upper end of said side core is configured to be positionable substantially at a higher upper end selected from one of said upper end of said cylinder head cover and said upper end of said iron made plug tube, and said upper end of said side core is positioned lower than an upper end of said center core.

10. An ignition apparatus for use in an internal combustion engine comprising a center core;

a primary coil on a primary bobbin;

a secondary coil on a secondary bobbin and arranged an inner side of said primary coil;

an outer case; and a side core arranged on an outer periphery of said outer case;

said primary coil and said secondary coil arranged between said center core and said outer case, whereby the ignition apparatus is configured to be received in a plug hole which is formed by a cylinder head and a cylinder head cover of the internal combustion engine; wherein said side core comprises at least one silicon steel sheet and has a slit between two side wall ends extending to a horizontal direction of said side core, and said slit is arranged to prevent a one-turn short of a magnetic flux of said side core and to obtain a predetermined secondary voltage in excess of an engine required secondary voltage, wherein the engine in which said ignition apparatus is configured to be used has said cylinder head of an aluminum material and said cylinder head cover of a thermoplastic synthetic resin material, and said side core is formed in a substantially pipe-like form and laminated with at least two sheets of a grain oriented silicon steel, each having a sheet thickness of 0.3–0.5 mm and said side core having a total sheet thickness of more than 0.6 mm, and each sheet having a slit between two horizontally extending side wall ends and said plural slits arranged to be aligned at substantially the same position.

11. An ignition apparatus for use in an internal combustion engine according to claim 10, wherein an upper end of said side core is positioned substantial at an upper end of said cylinder head cover or said upper end of said side core is positioned lower than an upper end of said center core.

12. An ignition apparatus for use in an internal combustion engine comprising a center core;

a primary coil on a primary bobbin;

a secondary coil on a secondary bobbin and arranged an inner side of said primary coil;

an outer case; and a side core arranged on an outer periphery of said outer case;

said primary coil and said secondary coil arranged between said center core and said outer case, whereby the ignition apparatus is configured to be received in a plug hole which is formed by a cylinder head and a cylinder head cover of the internal combustion engine; wherein said side core comprises at least one silicon steel sheet and has a slit between two side wall ends extending to a horizontal direction of said side core, and said slit is arranged to prevent a one-turn short of a magnetic flux of said side core and to obtain a predetermined secondary voltage in excess of an engine required secondary voltage, wherein an iron made plug tube is configured to be inserted under pressure in said plug hole of the internal combustion engine, and said side core is formed in a substantially pipe-like form and laminated with one of a single grain non-oriented steel sheet having a slit between two horizontally extending side wall ends and having a sheet thickness of 0.3–0.5 mm and a single grain oriented steel sheet having a slit between two horizontally extending side wall ends and having a sheet thickness of 0.3–0.5 mm.

13. An ignition apparatus for use in an internal combustion engine according to claim 12, wherein an upper end of said side core is configured so as to be positionable substantially at an upper end of said cylinder head cover or said upper end of said side core is positioned lower than an upper end of said center core.

14. An ignition apparatus for use in an internal combustion engine, comprising;

a center core;

a primary coil on a primary bobbin;

a secondary coil on a secondary bobbin and arranged on an inner side of said primary coil;

an outer case; and a side core arranged on an outer periphery of said outer case and made of a silicon steel sheet;

said primary coil and said secondary coil arranged between said center core and said outer case, whereby the ignition apparatus is configured to be received in a plug hole which is formed by a cylinder head and a cylinder head cover of the internal combustion engine; wherein said side core comprises at least one silicon steel sheet and has a slit extending in a substantially longitudinal direction of said side core, and whereby said slit prevents a one-turn short of a magnetic flux of said side core, so as to obtain a predetermined secondary voltage in excess of an engine required secondary voltage.

15. An ignition apparatus for use in an internal combustion engine, comprising a center core;

a primary coil on a primary bobbin;

a secondary coil on a secondary bobbin and arranged on an inner side of said primary coil, an outer case; and a side core arranged on an outer periphery of said outer case and made of a silicon steel sheet;

said primary coil and said secondary coil arranged between said center core and said outer case, whereby the ignition apparatus is configured to be received in a plug hole which is formed by a cylinder head and a cylinder head corer of the internal combustion engine; wherein said side core comprises at least one silicon steel sheet, and means is provided for preventing a one-turn short of a magnetic flux of said side core, said means comprising a substantially longitudinally extending slit in said side core.

* * * * *